US012449165B2

(12) United States Patent
Iyoshi et al.

(10) Patent No.: US 12,449,165 B2
(45) Date of Patent: Oct. 21, 2025

(54) REFRIGERATION CYCLE SYSTEM

(71) Applicant: DAIKIN INDUSTRIES, LTD., Osaka (JP)

(72) Inventors: Yuta Iyoshi, Osaka (JP); Yoshiki Yamanoi, Osaka (JP); Kumiko Saeki, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 134 days.

(21) Appl. No.: 18/204,024

(22) Filed: May 31, 2023

(65) Prior Publication Data

US 2023/0324085 A1 Oct. 12, 2023

Related U.S. Application Data

(63) Continuation of application No. PCT/JP2021/043883, filed on Nov. 30, 2021.

(30) Foreign Application Priority Data

Dec. 1, 2020 (JP) ..... 2020-199795

(51) Int. Cl.
*F25B 7/00* (2006.01)
*F25B 41/40* (2021.01)

(52) U.S. Cl.
CPC ..... *F25B 7/00* (2013.01); *F25B 41/40* (2021.01)

(58) Field of Classification Search
CPC ..... F25B 7/00; F25B 41/40; F25B 2400/16; F25B 2400/13; F25B 43/006
See application file for complete search history.

(56) References Cited

U.S. PATENT DOCUMENTS

2010/0050675 A1* 3/2010 Kameyama ..... F25B 30/02 62/238.7

FOREIGN PATENT DOCUMENTS

| | | | |
|---|---|---|---|
| EP | 2 910 870 | A1 | 8/2015 |
| EP | 2 672 204 | B1 | 7/2017 |
| EP | 3 348.934 | A1 | 7/2018 |
| EP | 3 643 988 | A | 4/2020 |
| JP | 59-38568 | A | 3/1984 |
| JP | 61-41563 | U | 3/1986 |
| JP | 2002228284 | A * | 8/2002 |

(Continued)

OTHER PUBLICATIONS

Extended European Search Report for European Application No. 21900596.4, dated Apr. 26, 2024.

(Continued)

*Primary Examiner* — Miguel A Diaz
(74) *Attorney, Agent, or Firm* — Birch, Stewart, Kolasch & Birch, LLP

(57) ABSTRACT

A primary refrigerant circuit allows circulation of a primary refrigerant, the primary refrigerant circuit including a primary compressor, a cascade heat exchanger, a primary receiver, and a primary heat exchanger. A secondary refrigerant circuit allows circulation of a secondary refrigerant, the secondary refrigerant circuit including a secondary compressor, the cascade heat exchanger, and a utilization heat exchanger; a primary casing accommodating the primary compressor; and a heat source casing accommodating the secondary compressor. The receiver is provided outside the primary casing.

4 Claims, 8 Drawing Sheets

(56) References Cited

FOREIGN PATENT DOCUMENTS

| | | | |
|---|---|---|---|
| JP | 2004-190917 | A | 7/2004 |
| JP | 2007-218460 | A | 8/2007 |
| JP | 2008-39332 | A | 2/2008 |
| JP | 2013-210150 | A | 10/2013 |
| JP | 2014-109405 | A | 6/2014 |
| JP | 5627417 | B2 | 11/2014 |
| JP | 2016-11783 | A | 1/2016 |
| JP | 2018-112367 | A | 7/2018 |
| JP | 2019-20090 | A | 2/2019 |
| WO | WO 2014/045400 | A1 | 3/2014 |
| WO | WO 2018/235832 | A1 | 12/2018 |

OTHER PUBLICATIONS

English translation of the International Search Report, for International Application No. PCT/JP2021/017705 mailed on Jun. 22, 2021.

International Preliminary Report on Patentability and English translation of the Written Opinion of the International Searching Authority, for International Application No. PCT/JP2021/017705 mailed on Nov. 17, 2022.

International Search Report for PCT/JP2021/043883 mailed on Jan. 11, 2022.

International Preliminary Report on Patentability and English translation of the Written Opinion of the International Searching Authority for International Application No. PCT/JP2021/043883, dated Jun. 15, 2023.

Extended European Search Report for European Application No. 21800672.4, dated Sep. 5, 2023.

* cited by examiner

REFRIGERATION CYCLE SYSTEM

CROSS REFERENCE TO RELATED APPLICATIONS

This application is a Continuation of PCT International Application No. PCT/JP2021/043883, filed on Nov. 30, 2021, which claims priority under 35 U.S.C. § 119(a) to Patent Application No. JP 2020-199795, filed in Japan on Dec. 1, 2020, all of which are hereby expressly incorporated by reference into the present application.

TECHNICAL FIELD

The present disclosure relates to a refrigeration cycle system.

BACKGROUND ART

There has conventionally been known a binary refrigeration apparatus including a primary refrigerant circuit and a secondary refrigerant circuit connected to each other via a cascade heat exchanger.

For example, Patent Literature 1 (WO 2018/235832 A) proposes a refrigeration apparatus including a secondary refrigerant circuit provided with a receiver configured to process an excessive refrigerant.

SUMMARY

A refrigeration cycle system according to a first aspect includes a first circuit, a second circuit, a first casing, and a second casing. The first circuit allows circulation of the first refrigerant. The first circuit includes a first compressor, a cascade heat exchanger, a receiver, and a first heat exchanger. The second circuit allows circulation of a second refrigerant. The second circuit includes a second compressor, the cascade heat exchanger, and a second heat exchanger. The first casing accommodates the first compressor. The second casing accommodates the second compressor. The receiver is provided outside the first casing.

DESCRIPTION OF EMBODIMENTS

(1) Configuration of Refrigeration Cycle System

Figure 1:
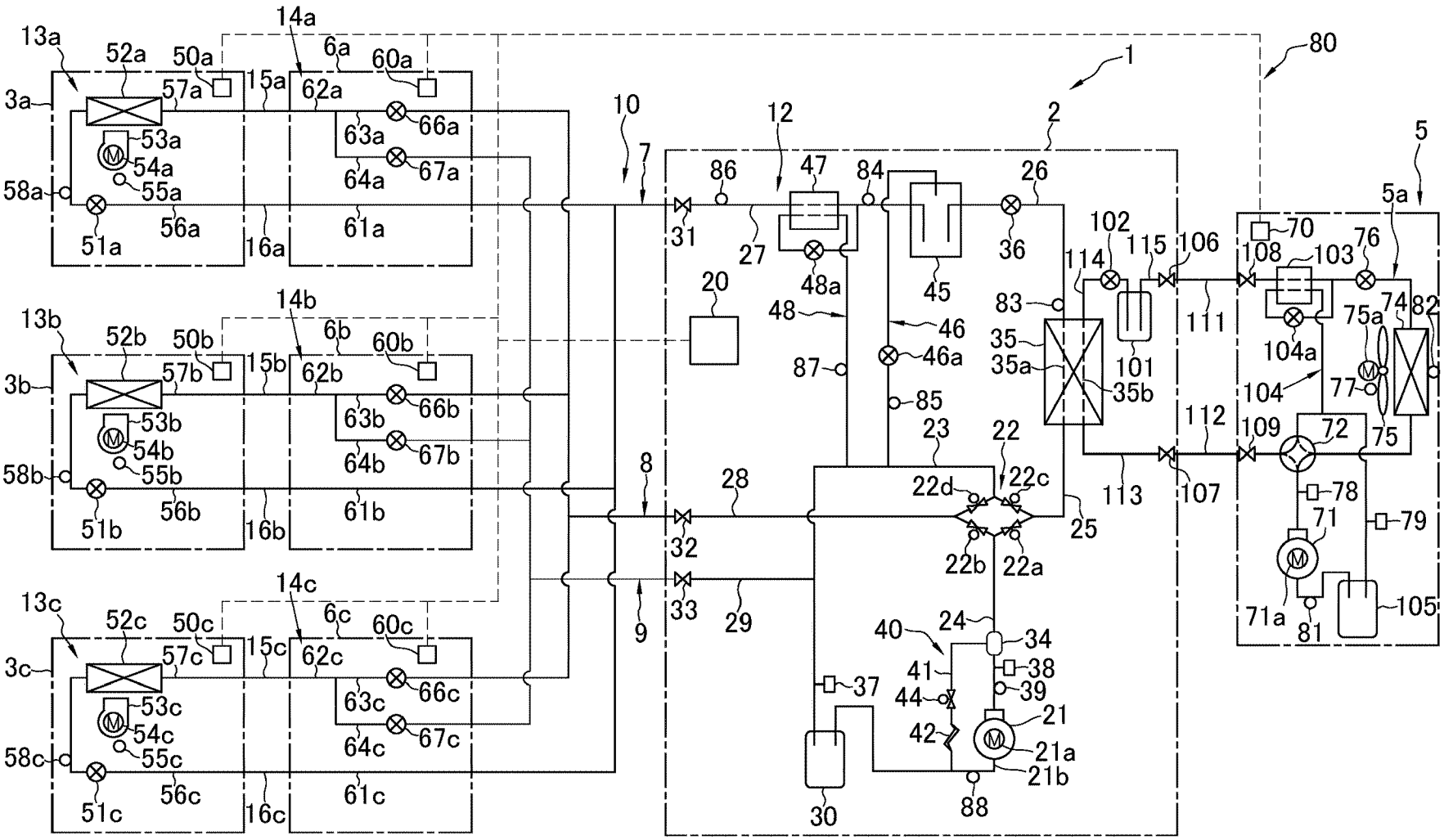
FIG. 1 is a schematic configuration diagram of a refrigeration cycle system.
Figure 2:
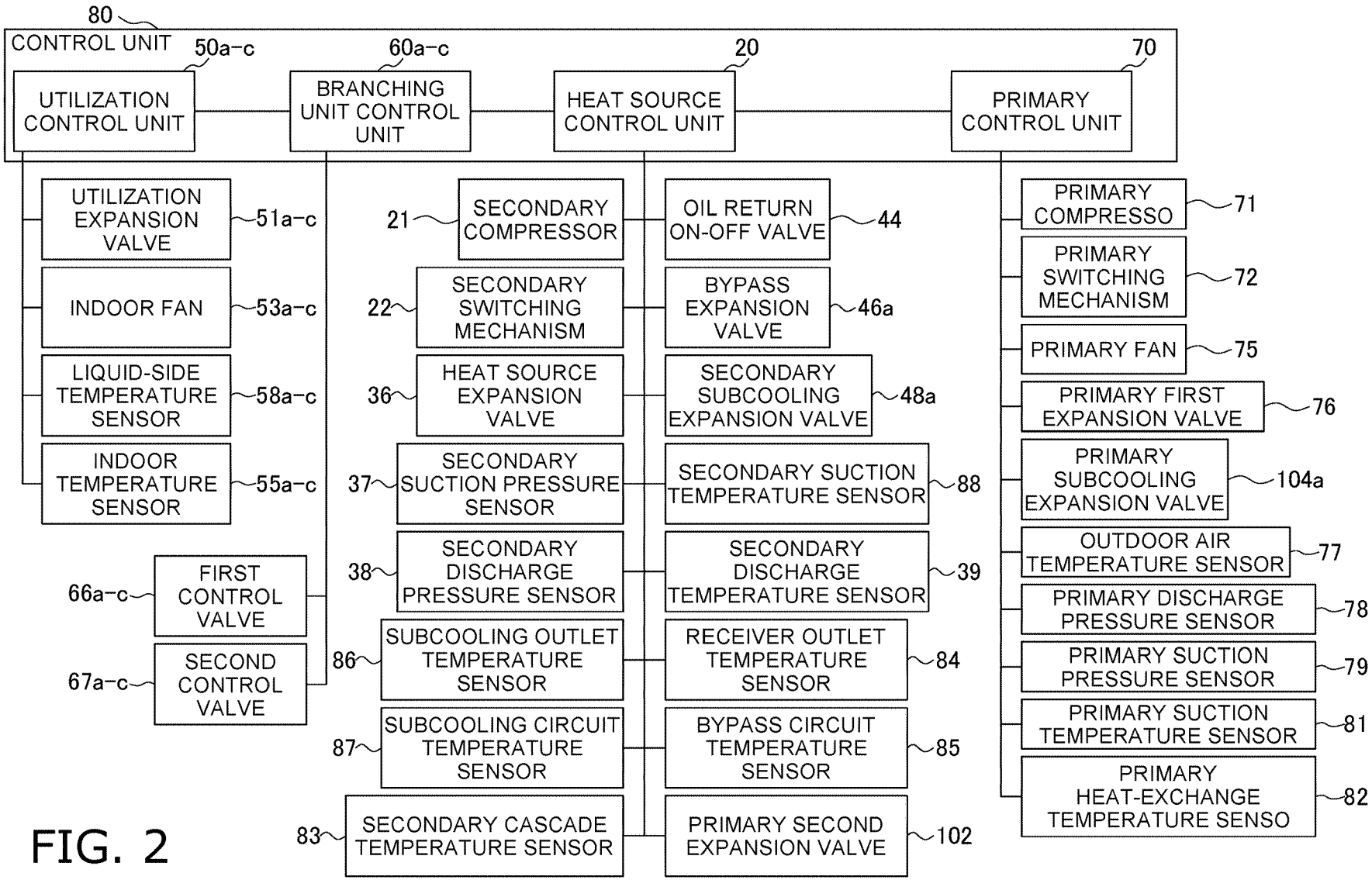
FIG. 2 is a schematic functional block configuration diagram of the refrigeration cycle system.

FIG. 1 is a schematic configuration diagram of a refrigeration cycle system 1. FIG. 2 is a schematic functional block configuration diagram of the refrigeration cycle system 1.

The refrigeration cycle system 1 is configured to execute vapor compression refrigeration cycle operation to be used for cooling or heating an indoor space of a building or the like.

The refrigeration cycle system 1 includes a binary refrigerant circuit consisting of a vapor compression primary refrigerant circuit 5*a* (corresponding to a first circuit) and a vapor compression secondary refrigerant circuit 10 (corresponding to a second circuit), and achieves a binary refrigeration cycle. The primary refrigerant circuit 5*a* encloses a refrigerant such as R32 (corresponding to a first refrigerant). The secondary refrigerant circuit 10 encloses a refrigerant such as carbon dioxide (corresponding to a second refrigerant). The primary refrigerant circuit 5*a* and the secondary refrigerant circuit 10 are thermally connected via a cascade heat exchanger 35 to be described later.

The refrigeration cycle system 1 includes a primary unit 5, a heat source unit 2, a plurality of branching units 6*a*, 6*b*, and 6*c*, and a plurality of utilization units 3*a*, 3*b*, and 3*c*, which are connected correspondingly via pipes. The primary unit 5 and the heat source unit 2 are connected via a primary first connection pipe 111 and a primary second connection pipe 112. The heat source unit 2 and the plurality of branching units 6*a*, 6*b*, and 6*c* are connected via three refrigerant connection pipes, namely, a secondary second connection pipe 9, a secondary first connection pipe 8, and a secondary third connection pipe 7. The plurality of branching units 6*a*, 6*b*, and 6*c* and the plurality of utilization units 3*a*, 3*b*, and 3*c* are connected via first connecting tubes 15*a*, 15*b*, and 15*c* and second connecting tubes 16*a*, 16*b*, and 16*c*. The present embodiment provides the single primary unit 5. The present embodiment provides the single heat source unit 2. The plurality of utilization units 3*a*, 3*b*, and 3*c* according to the present embodiment includes three utilization units, namely, a first utilization unit 3*a*, a second utilization unit 3*b*, and a third utilization unit 3*c*. The plurality of branching units 6*a*, 6*b*, and 6*c* according to the present embodiment includes three branching units, namely, a first branching unit 6*a*, a second branching unit 6*b*, and a third branching unit 6*c*.

In the refrigeration cycle system 1, the utilization units 3*a*, 3*b*, and 3*c* are configured to individually execute cooling operation or heating operation, and a utilization unit executing heating operation can send a refrigerant to a utilization unit executing cooling operation to achieve heat recovery between the utilization units. Specifically, heat recovery is achieved in the present embodiment by executing mainly cooling operation or mainly heating operation of simultaneously executing cooling operation and heating operation. Furthermore, the refrigeration cycle system 1 is configured to balance a heat load of the heat source unit 2 in accordance with heat loads of all the plurality of utilization units 3*a*, 3*b*, and 3*c* also in consideration of heat recovery mentioned above (mainly cooling operation or mainly heating operation).

(2) Primary Refrigerant Circuit

The primary refrigerant circuit 5*a* includes a primary compressor 71 (corresponding to a first compressor), a primary switching mechanism 72, a primary heat exchanger 74 (corresponding to a first heat exchanger), a primary first expansion valve 76, a primary subcooling heat exchanger 103, a primary subcooling circuit 104, a primary subcooling expansion valve 104*a*, a first liquid shutoff valve 108, the primary first connection pipe 111 (corresponding to a first pipe), a second liquid shutoff valve 106, a first connecting pipe 115, a primary receiver 101, a third connecting pipe 114, a primary second expansion valve 102 (corresponding to an expansion valve), the cascade heat exchanger 35 shared with the secondary refrigerant circuit 10, a second connecting pipe 113, a second gas shutoff valve 107, the primary second connection pipe 112 (corresponding to a second pipe), a first gas shutoff valve 109, and a primary accumulator 105.

The primary compressor 71 is configured to compress a primary refrigerant, and is exemplarily constituted by a positive-displacement compressor of a scroll type or the like configured to inverter control a compressor motor 71*a* to have variable operating capacity.

The primary accumulator 105 is provided at a halfway portion of a suction flow path connecting the primary switching mechanism 72 and a suction side of the primary compressor 71.

In a case where the cascade heat exchanger 35 functions as an evaporator for the primary refrigerant, the primary switching mechanism 72 comes into a fifth connection state of connecting a suction side of the primary compressor 71 and a gas side of a primary flow path 35*b* of the cascade heat exchanger 35 (see solid lines in the primary switching mechanism 72 in FIG. 1). In another case where the cascade heat exchanger 35 functions as a radiator for the primary refrigerant, the primary switching mechanism 72 comes into a sixth connection state of connecting a discharge side of the primary compressor 71 and the gas side of the primary flow path 35*b* of the cascade heat exchanger 35 (see broken lines in the primary switching mechanism 72 in FIG. 1). The primary switching mechanism 72 is thus configured to switch the flow path of the refrigerant in the primary refrigerant circuit 5*a*, and is exemplarily constituted by a four-way switching valve. With change in switching state of the primary switching mechanism 72, the cascade heat exchanger 35 can function as the evaporator or the radiator for the primary refrigerant.

The cascade heat exchanger 35 is configured to cause heat exchange between the primary refrigerant such as R32 and a secondary refrigerant such as carbon dioxide without mixing the refrigerants. The cascade heat exchanger 35 is exemplarily constituted by a plate heat exchanger. The cascade heat exchanger 35 includes a secondary flow path 35*a* belonging to the secondary refrigerant circuit 10, and the primary flow path 35*b* belonging to the primary refrigerant circuit 5*a*. The secondary flow path 35*a* has a gas side connected to a secondary switching mechanism 22 via a third heat source pipe 25, and a liquid side connected to a heat source expansion valve 36 via a fourth heat source pipe 26. The primary flow path 35*b* has the gas side connected to the primary compressor 71 via the second connecting pipe 113, the second gas shutoff valve 107, the primary second connection pipe 112, the first gas shutoff valve 109, and the primary switching mechanism 72, and a liquid side connected to the primary second expansion valve 102 provided on the third connecting pipe 114.

The primary heat exchanger 74 is configured to cause heat exchange between the primary refrigerant and outdoor air. The primary heat exchanger 74 has a gas side connected to a pipe extending from the primary switching mechanism 72. Examples of the primary heat exchanger 74 include a fin-and-tube heat exchanger constituted by large numbers of heat transfer tubes and fins.

The primary first expansion valve 76 is provided on a liquid pipe extending from a liquid side of the primary heat exchanger 74 to the primary subcooling heat exchanger 103. The primary first expansion valve 76 is an electrically powered expansion valve configured to control a flow rate of the primary refrigerant flowing in a portion adjacent to a liquid side of the primary refrigerant circuit 5*a* and having a controllable opening degree.

The primary subcooling circuit 104 branches from a portion between the primary first expansion valve 76 and the primary subcooling heat exchanger 103, and is connected to a portion between the primary switching mechanism 72 and the primary accumulator 105 on the suction flow path. The primary subcooling expansion valve 104*a* is an electrically powered expansion valve that is provided upstream of the primary subcooling heat exchanger 103 in the primary subcooling circuit 104 and is configured to control the flow rate of the primary refrigerant, and having a controllable opening degree.

The primary subcooling heat exchanger 103 is configured to cause heat exchange between a refrigerant flowing from the primary first expansion valve 76 toward the first liquid shutoff valve 108 and a refrigerant decompressed at the primary subcooling expansion valve 104*a* in the primary subcooling circuit 104.

The primary first connection pipe 111 is a pipe connecting the first liquid shutoff valve 108 and the second liquid shutoff valve 106, and connects the primary unit 5 and the heat source unit 2.

The primary second connection pipe 112 is a pipe connecting the first gas shutoff valve 109 and the second gas shutoff valve 107, and connects the primary unit 5 and the heat source unit 2.

The first connecting pipe 115 extends from the second liquid shutoff valve 106 into the inner part of the primary receiver 101.

The third connecting pipe 114 extends from the liquid side of the primary flow path 35*b* of the cascade heat exchanger 35 into the inner part of the primary receiver 101.

The primary second expansion valve 102 is provided on the third connecting pipe 114.

The primary receiver 101 is a refrigerant reservoir configured to reserve an excessive refrigerant of the primary refrigerant in the primary refrigerant circuit 5*a*. A liquid phase region corresponding to a lower region in the primary receiver 101 is provided with an end of the first connecting pipe 115 extending from the second liquid shutoff valve 106 and an end of the third connecting pipe 114 extending from the liquid side of the primary flow path 35*b* of the cascade heat exchanger 35.

The third connecting pipe 114 and the first connecting pipe 115 each have an outlet disposed in the primary receiver 101 and preferably directed downward. This inhibits the primary refrigerant from foaming in the primary receiver 101.

The second connecting pipe 113 extends from the gas side of the primary flow path 35*b* of the cascade heat exchanger 35 to the second gas shutoff valve 107.

The first gas shutoff valve 109 is provided at a portion between the primary second connection pipe 112 and the primary switching mechanism 72.

(3) Secondary Refrigerant Circuit

The secondary refrigerant circuit 10 includes the plurality of utilization units 3*a*, 3*b*, and 3*c*, the plurality of branching units 6*a*, 6*b*, and 6*c*, and the heat source unit 2, which are connected correspondingly. Each of the utilization units 3*a*, 3*b*, and 3*c* is connected to a corresponding one of the branching units 6*a*, 6*b*, and 6*c* one by one. Specifically, the utilization unit 3*a* and the branching unit 6*a* are connected via the first connecting tube 15*a* and the second connecting tube 16*a*, the utilization unit 3*b* and the branching unit 6*b* are connected via the first connecting tube 15*b* and the second connecting tube 16*b*, and the utilization unit 3*c* and the branching unit 6*c* are connected via the first connecting tube 15*c* and the second connecting tube 16*c*. Each of the branching units 6*a*, 6*b*, and 6*c* are connected to the heat source unit 2 via three refrigerant connection pipes, namely, the secondary third connection pipe 7, the secondary first connection pipe 8, and the secondary second connection pipe 9. Specifically, the secondary third connection pipe 7, the secondary first connection pipe 8, and the secondary second connection pipe 9 extending from the heat source unit 2 are each branched into a plurality of pipes connected to the branching units 6*a*, 6*b*, and 6*c*.

The secondary first connection pipe 8 has a flow of either the refrigerant in a gas-liquid two-phase state or the refrigerant in a gas state in accordance with an operating state. Depending on the type of the second refrigerant, the secondary first connection pipe 8 has a flow of the refrigerant in a supercritical state in accordance with the operating state. The secondary second connection pipe 9 has a flow of either the refrigerant in the gas-liquid two-phase state or the refrigerant in the gas state in accordance with the operating state. The secondary third connection pipe 7 has a flow of either the refrigerant in the gas-liquid two-phase state or the refrigerant in a liquid state in accordance with the operating state. Depending on the type of the second refrigerant, the secondary third connection pipe 7 has a flow of the refrigerant in the supercritical state in accordance with the operating state.

The secondary refrigerant circuit 10 includes a heat source circuit 12, branching circuits 14*a*, 14*b*, and 14*c*, and a utilization circuits 13*a*, 13*b*, and 13*c*, which are connected correspondingly.

The heat source circuit 12 principally includes a secondary compressor 21 (corresponding to a second compressor), the secondary switching mechanism 22, a first heat source pipe 28, a second heat source pipe 29, a suction flow path 23, a discharge flow path 24, the third heat source pipe 25, the fourth heat source pipe 26, a fifth heat source pipe 27, the cascade heat exchanger 35, the heat source expansion valve 36, a third shutoff valve 31, a first shutoff valve 32, a second shutoff valve 33, a secondary accumulator 30, an oil separator 34, an oil return circuit 40, a secondary receiver 45, a bypass circuit 46, a bypass expansion valve 46*a*, a secondary subcooling heat exchanger 47, a secondary subcooling circuit 48, and a secondary subcooling expansion valve 48*a*.

The secondary compressor 21 is configured to compress the secondary refrigerant, and is exemplarily constituted by a positive-displacement compressor of a scroll type or the like configured to inverter control a compressor motor 21*a* to have variable operating capacity. The secondary compressor 21 is controlled in accordance with an operating load so as to have larger operating capacity as the load increases.

The secondary switching mechanism 22 is configured to switch a connection state of the secondary refrigerant circuit 10, specifically, the flow path of the refrigerant in the heat source circuit 12. The secondary switching mechanism 22 according to the present embodiment includes four switching valves 22*a*, 22*b*, 22*c*, and 22*d* constituted as two-way valves aligned on an annular flow path. The secondary switching mechanism 22 may alternatively be constituted by a plurality of three-way switching valves combined together. The secondary switching mechanism 22 includes the first switching valve 22*a* provided on a flow path connecting the discharge flow path 24 and the third heat source pipe 25, the second switching valve 22*b* provided on a flow path connecting the discharge flow path 24 and the first heat source pipe 28, the third switching valve 22*c* provided on a flow path connecting the suction flow path 23 and the third heat source pipe 25, and the fourth switching valve 22*d* provided on a flow path connecting the suction flow path 23 and the first heat source pipe 28. Each of the first switching valve 22*a*, the second switching valve 22*b*, the third switching valve 22*c*, and the fourth switching valve 22*d* according to the present embodiment is an electromagnetic valve configured to be switchable between an opened state and a closed state.

In a case where the cascade heat exchanger 35 functions as a radiator for the secondary refrigerant, the secondary switching mechanism 22 comes into a first connection state of bringing the first switching valve 22*a* into the opened state to connect a discharge side of the secondary compressor 21 and the gas side of the secondary flow path 35*a* of the cascade heat exchanger 35, and bringing the third switching valve 22*c* into the closed state. In another case where the cascade heat exchanger 35 functions as an evaporator for the secondary refrigerant, the secondary switching mechanism 22 comes into a second connection state of bringing the third switching valve 22*c* into the opened state to connect a suction side of the secondary compressor 21 and the gas side of the secondary flow path 35*a* of the cascade heat exchanger 35, and bringing the first switching valve 22*a* into the closed state. In a case where the secondary refrigerant discharged from the secondary compressor 21 is sent to the secondary first connection pipe 8, the secondary switching mechanism 22 comes into a third connection state of bringing the second switching valve 22*b* into the opened state to connect the discharge side of the secondary compressor 21 and the secondary first connection pipe 8, and bringing the fourth switching valve 22*d* into the closed state. In another case where the refrigerant flowing in the secondary first connection pipe 8 is sucked into the secondary compressor 21, the secondary switching mechanism 22 comes into a fourth connection state of bringing the fourth switching valve 22*d* into the opened state to connect the secondary first connection pipe 8 and the suction side of the secondary compressor 21, and bringing the second switching valve 22*b* into the closed state.

As described above, the cascade heat exchanger 35 is configured to cause heat exchange between the primary refrigerant such as R32 and the secondary refrigerant such as carbon dioxide without mixing the refrigerants. The cascade heat exchanger 35 includes the secondary flow path 35*a* having a flow of the secondary refrigerant in the secondary refrigerant circuit 10 and the primary flow path 35*b* having a flow of the primary refrigerant in the primary refrigerant circuit 5*a*, so as to be shared between the primary unit 5 and the heat source unit 2. The cascade heat exchanger 35 according to the present embodiment is disposed in a heat source casing 2*x* of the heat source unit 2. The gas side of the primary flow path 35*b* of the cascade heat exchanger 35 extends to the primary second connection pipe 112 outside the heat source casing 2*x* via the second connecting pipe 113 and the second gas shutoff valve 107. The liquid side of the primary flow path 35*b* of the cascade heat exchanger 35 extends to the primary first connection pipe 111 outside the heat source casing 2*x* via the third connecting pipe 114, the primary second expansion valve 102, the primary receiver 101, the first connecting pipe 115, and the second liquid shutoff valve 106.

The heat source expansion valve 36 is an electrically powered expansion valve having a controllable opening degree and connected to a liquid side of the cascade heat exchanger 35, in order to control and the like of a flow rate of the secondary refrigerant flowing in the cascade heat exchanger 35. The heat source expansion valve 36 is provided on the fourth heat source pipe 26.

Each of the third shutoff valve 31, the first shutoff valve 32, and the second shutoff valve 33 is provided at a connecting port with an external device or pipe (specifically, the connection pipe 7, 8, or 9). Specifically, the third shutoff valve 31 is connected to the secondary third connection pipe 7 led out of the heat source unit 2. The first shutoff valve 32 is connected to the secondary first connection pipe 8 led out of the heat source unit 2. The second shutoff valve 33 is connected to the secondary second connection pipe 9 led out of the heat source unit 2.

The first heat source pipe 28 is a refrigerant pipe connecting the first shutoff valve 32 and the secondary switching mechanism 22. Specifically, the first heat source pipe 28 connects the first shutoff valve 32 and a portion between the second switching valve 22*b* and the fourth switching valve 22*d* in the secondary switching mechanism 22.

The suction flow path 23 connects the secondary switching mechanism 22 and the suction side of the secondary compressor 21. Specifically, the suction flow path 23 connects a portion between the third switching valve 22*c* and the fourth switching valve 22*d* in the secondary switching mechanism 22 and the suction side of the secondary compressor 21. The suction flow path 23 has a halfway portion provided with the secondary accumulator 30.

The second heat source pipe 29 is a refrigerant pipe connecting the second shutoff valve 33 and another halfway portion of the suction flow path 23. The second heat source pipe 29 according to the present embodiment is connected to the suction flow path 23 at a connection point between the portion between the second switching valve 22*b* and the fourth switching valve 22*d* in the secondary switching mechanism 22 and the secondary accumulator 30 on the suction flow path 23.

The discharge flow path 24 is a refrigerant pipe connecting the discharge side of the secondary compressor 21 and the secondary switching mechanism 22. Specifically, the discharge flow path 24 connects the discharge side of the secondary compressor 21 and a portion between the first switching valve 22*a* and the second switching valve 22*b* in the secondary switching mechanism 22.

The third heat source pipe 25 is a refrigerant pipe connecting the secondary switching mechanism 22 and a gas side of the cascade heat exchanger 35. Specifically, the third heat source pipe 25 connects a portion between the first switching valve 22*a* and the third switching valve 22*c* in the secondary switching mechanism 22 and a gas side end of the secondary flow path 35*a* in the cascade heat exchanger 35.

The fourth heat source pipe 26 is a refrigerant pipe connecting the liquid side (opposite to the gas side, and opposite to the side provided with the secondary switching mechanism 22) of the cascade heat exchanger 35 and the secondary receiver 45. Specifically, the fourth heat source pipe 26 connects a liquid side end (opposite end to the gas side) of the secondary flow path 35*a* in the cascade heat exchanger 35 and the secondary receiver 45.

The secondary receiver 45 is a refrigerant reservoir configured to reserve a residue refrigerant in the secondary refrigerant circuit 10. The secondary receiver 45 is provided with the fourth heat source pipe 26, the fifth heat source pipe 27, and the bypass circuit 46 extending outward.

The bypass circuit 46 is a refrigerant pipe connecting a gas phase region corresponding to an upper region in the secondary receiver 45 and the suction flow path 23. Specifically, the bypass circuit 46 is connected between the secondary switching mechanism 22 and the secondary accumulator 30 on the suction flow path 23. The bypass circuit 46 is provided with the bypass expansion valve 46*a*. The bypass expansion valve 46*a* is an electrically powered expansion valve having a controllable opening degree to control quantity of the refrigerant guided from inside the secondary receiver 45 to the suction side of the secondary compressor 21.

The fifth heat source pipe 27 is a refrigerant pipe connecting the secondary receiver 45 and the third shutoff valve 31.

The secondary subcooling circuit 48 is a refrigerant pipe connecting a part of the fifth heat source pipe 27 and the suction flow path 23. Specifically, the secondary subcooling circuit 48 is connected between the secondary switching mechanism 22 and the secondary accumulator 30 on the suction flow path 23. The secondary subcooling circuit 48 according to the present embodiment extends to branch from a portion between the secondary receiver 45 and the secondary subcooling heat exchanger 47.

The secondary subcooling heat exchanger 47 is configured to cause heat exchange between the refrigerant flowing in a flow path belonging to the fifth heat source pipe 27 and the refrigerant flowing in a flow path belonging to the secondary subcooling circuit 48. The secondary subcooling heat exchanger 47 according to the present embodiment is provided between a portion from where the secondary subcooling circuit 48 branches and the third shutoff valve 31 on the fifth heat source pipe 27. The secondary subcooling expansion valve 48*a* is provided between a portion branching from the fifth heat source pipe 27 and the secondary subcooling heat exchanger 47 on the secondary subcooling circuit 48. The secondary subcooling expansion valve 48*a* is an electrically powered expansion valve having a controllable opening degree and configured to supply the secondary subcooling heat exchanger 47 with a decompressed refrigerant.

The secondary accumulator 30 is a reservoir configured to reserve the secondary refrigerant, and is provided on the suction side of the secondary compressor 21.

The oil separator 34 is provided at a halfway portion of the discharge flow path 24. The oil separator 34 is configured to separate refrigerating machine oil discharged from the secondary compressor 21 along with the secondary refrigerant from the secondary refrigerant and return the refrigerating machine oil to the secondary compressor 21.

The oil return circuit 40 is provided to connect the oil separator 34 and the suction flow path 23. The oil return circuit 40 includes an oil return flow path 41 as a flow path extending from the oil separator 34 and extending to join a portion between the secondary accumulator 30 and the suction side of the secondary compressor 21 on the suction flow path 23. The oil return flow path 41 has a halfway portion provided with an oil return capillary tube 42 and an oil return on-off valve 44. When the oil return on-off valve 44 is controlled into the opened state, the refrigerating machine oil separated in the oil separator 34 passes the oil return capillary tube 42 on the oil return flow path 41 and is returned to the suction side of the secondary compressor 21. When the secondary compressor 21 is in operation on the secondary refrigerant circuit 10, the oil return on-off valve 44 according to the present embodiment repetitively is kept in the opened state for predetermined time and is kept in the closed state for predetermined time, to control returned quantity of the refrigerating machine oil through the oil return circuit 40. The oil return on-off valve 44 according to the present embodiment is an electromagnetic valve controlled to be opened and closed. The oil return on-off valve 44 may alternatively be an electrically powered expansion valve having a controllable opening degree and not provided with the oil return capillary tube 42. Description is made below to the utilization circuits 13*a*, 13*b*, and 13*c*. As the utilization circuits 13*b* and 13*c* are configured similarly to the utilization circuit 13*a*, elements of the utilization circuits 13*b* and 13*c* will not be described repeatedly, assuming that a subscript "b" or "c" will replace a subscript "a" in reference signs denoting elements of the utilization circuit 13*a*.

The utilization circuit 13*a* principally includes a utilization heat exchanger 52*a* (corresponding to a second heat exchanger), a first utilization pipe 57*a*, a second utilization pipe 56*a*, and a utilization expansion valve 51*a*.

The utilization heat exchanger 52*a* is configured to cause heat exchange between a refrigerant and indoor air, and examples thereof include a fin-and-tube heat exchanger constituted by large numbers of heat transfer tubes and fins. The plurality of utilization heat exchangers 52*a*, 52*b*, and 52*c* are connected in parallel to the secondary switching mechanism 22, the suction flow path 23, and the cascade heat exchanger 35.

The second utilization pipe 56*a* has a first end connected to a liquid side (opposite to a gas side) of the utilization heat exchanger 52*a* in the first utilization unit 3*a*. The second utilization pipe 56*a* has a second end connected to the second connecting tube 16*a*. The second utilization pipe 56*a* has a halfway portion provided with the utilization expansion valve 51*a* described above.

The utilization expansion valve 51*a* is an electrically powered expansion valve configured to control a flow rate of the refrigerant flowing in the utilization heat exchanger 52*a*, and having a controllable opening degree. The utilization expansion valve 51*a* is provided on the second utilization pipe 56*a*.

The first utilization pipe 57*a* has a first end connected to the gas side of the utilization heat exchanger 52*a* in the first utilization unit 3*a*. The first utilization pipe 57*a* according to the present embodiment is connected to a portion opposite to the utilization expansion valve 51*a* of the utilization heat exchanger 52*a*. The first utilization pipe 57*a* has a second end connected to the first connecting tube 15*a*.

Description is made below to the branching circuits 14*a*, 14*b*, and 14*c*. As the branching circuits 14*b* and 14*c* are configured similarly to the branching circuit 14*a*, elements of the branching circuits 14*b* and 14*c* will not be described repeatedly, assuming that a subscript "b" or "c" will replace a subscript "a" in reference signs denoting elements of the branching circuit 14*a*.

The branching circuit 14*a* principally includes a junction pipe 62*a*, a first branching pipe 63*a*, a second branching pipe 64*a*, a first control valve 66*a*, a second control valve 67*a*, and a third branching pipe 61*a*.

The junction pipe 62*a* has a first end connected to the first connecting tube 15*a*. The junction pipe 62*a* has a second end branched to be connected with the first branching pipe 63*a* and the second branching pipe 64*a*.

The first branching pipe 63*a* has a portion opposite to the junction pipe 62*a* and connected to the secondary first connection pipe 8. The first branching pipe 63*a* is provided with the first control valve 66*a* configured to be opened and closed. The first control valve 66*a* is exemplified herein by an electrically powered expansion valve having a controllable opening degree, but may alternatively be an electromagnetic valve configured only to be opened and closed.

The second branching pipe 64*a* has a portion opposite to the junction pipe 62*a* and connected to the secondary second connection pipe 9. The second branching pipe 64*a* is provided with the second control valve 67*a* configured to be opened and closed. The second control valve 67*a* is exemplified herein by an electrically powered expansion valve having a controllable opening degree, but may alternatively be n electromagnetic valve configured only to be opened and closed.

The third branching pipe 61*a* has a first end connected to the second connecting tube 16*a*. The third branching pipe 61*a* has a second end connected to the secondary third connection pipe 7.

During cooling operation to be described later, the first branching unit 6*a* brings the first control valve 66*a* and the second control valve 67*a* into the opened state so as to function as follows. The first branching unit 6*a* sends, to the second connecting tube 16*a*, the refrigerant flowing into the third branching pipe 61*a* via the secondary third connection pipe 7. The refrigerant flowing in the second utilization pipe 56*a* in the first utilization unit 3*a* via the second connecting tube 16*a* is sent to the utilization heat exchanger 52*a* in the first utilization unit 3*a* via the utilization expansion valve 51*a*. The refrigerant sent to the utilization heat exchanger 52*a* is evaporated by heat exchange with indoor air, and then flows in the first connecting tube 15*a* via the first utilization pipe 57*a*. The refrigerant having flowed in the first connecting tube 15*a* is sent to the junction pipe 62*a* in the first branching unit 6*a*. The refrigerant having flowed in the junction pipe 62*a* is branched into the first branching pipe 63*a* and the second branching pipe 64*a*. The refrigerant having passed the first control valve 66*a* on the first branching pipe 63*a* is sent to the secondary first connection pipe 8. The refrigerant having passed the second control valve 67*a* on the second branching pipe 64*a* is sent to the secondary second connection pipe 9.

In a case where the first utilization unit 3*a* cools the indoor space during mainly cooling operation and mainly heating operation to be described later, the first branching unit 6*a* brings the first control valve 66*a* into the closed state and the second control valve 67*a* into the opened state so as to function as follows. The first branching unit 6*a* sends, to the second connecting tube 16*a*, the refrigerant flowing into the third branching pipe 61*a* via the secondary third connection pipe 7. The refrigerant flowing in the second utilization pipe 56*a* in the first utilization unit 3*a* via the second connecting tube 16*a* is sent to the utilization heat exchanger 52*a* in the first utilization unit 3*a* via the utilization expansion valve 51*a*. The refrigerant sent to the utilization heat exchanger 52*a* is evaporated by heat exchange with indoor air, and then flows in the first connecting tube 15*a* via the first utilization pipe 57*a*. The refrigerant having flowed in the first connecting tube 15*a* is sent to the junction pipe 62*a* in the first branching unit 6*a*. The refrigerant having flowed in the junction pipe 62*a* flows to the second branching pipe 64*a* and passes the second control valve 67*a* to be subsequently sent to the secondary second connection pipe 9.

During heating operation to be described later, the first branching unit 6*a* brings the second control valve 67*a* into the opened or closed state and brings the first control valve 66*a* into the opened state in accordance with an operation condition so as to function as follows. In the first branching unit 6*a*, the refrigerant flowing into the first branching pipe 63*a* via the secondary first connection pipe 8 passes the first control valve 66*a* to be sent to the junction pipe 62*a*. The refrigerant having flowed in the junction pipe 62*a* flows in the first utilization pipe 57*a* in the utilization unit 3*a* via the first connecting tube 15*a* to be sent to the utilization heat exchanger 52*a*. The refrigerant sent to the utilization heat exchanger 52*a* radiates heat through heat exchange with indoor air, and then passes the utilization expansion valve 51*a* provided on the second utilization pipe 56*a*. The refrigerant having passed the second utilization pipe 56*a* flows in the third branching pipe 61*a* in the first branching unit 6*a* via the second connecting tube 16*a* to be subsequently sent to the secondary third connection pipe 7.

In another case where the first utilization unit 3*a* heats the indoor space during mainly cooling operation and mainly heating operation to be described later, the first branching unit 6*a* brings the second control valve 67*a* into the closed state and brings the first control valve 66*a* into the opened state so as to function as follows. In the first branching unit 6*a*, the refrigerant flowing into the first branching pipe 63*a* via the secondary first connection pipe 8 passes the first control valve 66*a* to be sent to the junction pipe 62*a*. The refrigerant having flowed in the junction pipe 62*a* flows in the first utilization pipe 57*a* in the utilization unit 3*a* via the first connecting tube 15*a* to be sent to the utilization heat exchanger 52*a*. The refrigerant sent to the utilization heat exchanger 52*a* radiates heat through heat exchange with indoor air, and then passes the utilization expansion valve 51*a* provided on the second utilization pipe 56*a*. The refrigerant having passed the second utilization pipe 56*a* flows in the third branching pipe 61*a* in the first branching unit 6*a* via the second connecting tube 16*a* to be subsequently sent to the secondary third connection pipe 7.

The first branching unit 6*a*, as well as the second branching unit 6*b* and the third branching unit 6*c*, similarly have such a function. Accordingly, the first branching unit 6*a*, the second branching unit 6*b*, and the third branching unit 6*c* are configured to individually switchably cause the utilization heat exchangers 52*a*, 52*b*, and 52*c* to function as a refrigerant evaporator or a refrigerant radiator.

(4) Primary Unit

The primary unit 5 is disposed in a space different from a space provided with the utilization units 3*a*, 3*b*, and 3*c* and the branching units 6*a*, 6*b*, and 6*c*, on a roof, or the like.

Figure 7:
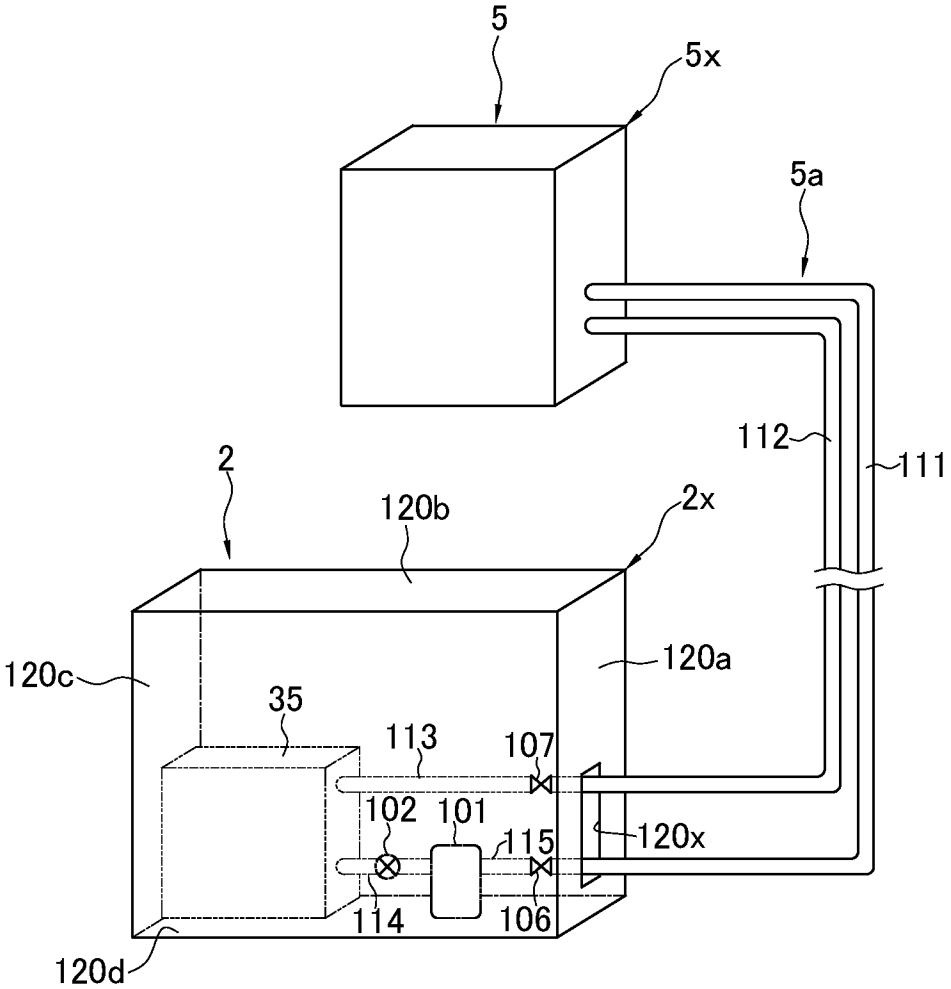
FIG. 7 is a schematic view depicting connection between a primary unit and a heat source unit.

The primary unit 5 includes part of the primary refrigerant circuit 5*a* described above, a primary fan 75, various sensors, a primary control unit 70, and a primary casing 5*x* (corresponding to a first casing) depicted in FIG. 7.

The primary unit 5 includes, as the part of the primary refrigerant circuit 5*a* accommodated in the primary casing 5*x*, the primary compressor 71, the primary switching mechanism 72, the primary heat exchanger 74, the primary first expansion valve 76, the primary subcooling heat exchanger 103, the primary subcooling circuit 104, the primary subcooling expansion valve 104*a*, the first liquid shutoff valve 108, the first gas shutoff valve 109, and the primary accumulator 105.

The primary fan 75 is provided in the primary unit 5, and is configured to generate an air flow of guiding outdoor air into the primary heat exchanger 74, and exhausting, to outdoors, air obtained after heat exchange with the primary refrigerant flowing in the primary heat exchanger 74. The primary fan 75 is driven by a primary fan motor 75*a*.

The primary unit 5 is provided with the various sensors. Specifically, there are provided an outdoor air temperature sensor 77 configured to detect temperature of outdoor air to be subject to pass the primary heat exchanger 74, a primary discharge pressure sensor 78 configured to detect pressure of the primary refrigerant discharged from the primary compressor 71, a primary suction pressure sensor 79 configured to detect pressure of the primary refrigerant sucked into the primary compressor 71, a primary suction temperature sensor 81 configured to detect temperature of the primary refrigerant sucked into the primary compressor 71, and a primary heat-exchange temperature sensor 82 configured to detect temperature of the refrigerant flowing in the primary heat exchanger 74.

The primary control unit 70 controls behavior of the elements 71 (71*a*), 72, 75 (75*a*), 76, and 104*a* provided in the primary unit 5. The primary control unit 70 includes a processor such as a CPU or a microcomputer provided to control the primary unit 5 and a memory, so as to transmit and receive control signals and the like to and from a remote controller (not depicted), and to transmit and receive control signals and the like among a heat source control unit 20 in the heat source unit 2, branching unit control units 60*a*, 60*b*, and 60*c*, and utilization control units 50*a*, 50*b*, and 50*c*.

(5) Heat Source Unit

The heat source unit 2 is disposed in a space different from the space provided with the utilization units 3*a*, 3*b*, and 3*c* and the branching units 6*a*, 6*b*, and 6*c*, on a roof, or the like.

The heat source unit 2 is connected to the branching units 6*a*, 6*b*, and 6*c* via the connection pipes 7, 8, and 9, to constitute part of the secondary refrigerant circuit 10. The heat source unit 2 is connected with the primary unit 5 via the primary first connection pipe 111 and the primary second connection pipe 112, to constitute part of the primary refrigerant circuit 5*a*.

The heat source unit 2 principally includes the heat source circuit 12 described above, various sensors, the heat source control unit 20, the second liquid shutoff valve 106 constituting part of the primary refrigerant circuit 5*a*, the first connecting pipe 115, the primary receiver 101, the third connecting pipe 114, the primary second expansion valve 102, the second connecting pipe 113, the second gas shutoff valve 107, and the heat source casing 2*x* (corresponding to a second casing) depicted in FIG. 7.

In the heat source casing 2*x*, the third connecting pipe 114 and the primary receiver 101 have a connection point that may be located below a vertical center of the primary receiver 101. Furthermore, the third connecting pipe 114 and the primary flow path 35*b* of the cascade heat exchanger 35 have a connection point that may be located below a vertical center of the cascade heat exchanger 35. This facilitates connection between the primary receiver 101 and the cascade heat exchanger 35.

The heat source unit 2 is provided with a secondary suction pressure sensor 37 configured to detect pressure of the secondary refrigerant on the suction side of the secondary compressor 21, a secondary discharge pressure sensor 38 configured to detect pressure of the secondary refrigerant on the discharge side of the secondary compressor 21, a secondary discharge temperature sensor 39 configured to detect temperature of the secondary refrigerant on the discharge side of the secondary compressor 21, a secondary suction temperature sensor 88 configured to detect temperature of the secondary refrigerant on the suction side of the secondary compressor 21, a secondary cascade temperature sensor 83 configured to detect temperature of the secondary refrigerant flowing between the secondary flow path 35*a* of the cascade heat exchanger 35 and the heat source expansion valve 36, a receiver outlet temperature sensor 84 configured to detect temperature of the secondary refrigerant flowing between the secondary receiver 45 and the secondary subcooling heat exchanger 47, a bypass circuit temperature sensor 85 configured to detect temperature of the secondary refrigerant flowing downstream of the bypass expansion valve 46*a* in the bypass circuit 46, a subcooling outlet temperature sensor 86 configured to detect temperature of the secondary refrigerant flowing between the secondary subcooling heat exchanger 47 and the third shutoff valve 31, and a subcooling circuit temperature sensor 87 configured to detect temperature of the secondary refrigerant flowing at an outlet of the secondary subcooling heat exchanger 47 in the secondary subcooling circuit 48.

The heat source control unit 20 controls behavior of the elements 21 (21*a*), 22, 36, 44, 46*a*, 48*a*, and 102 provided in the heat source casing 2*x* of the heat source unit 2. The heat source control unit 20 controls a valve opening degree of the primary second expansion valve 102 as a component constituting part of, not the secondary refrigerant circuit 10 but the primary refrigerant circuit 5*a*. The heat source control unit 20 includes a processor such as a CPU or a microcomputer provided to control the heat source unit 2 and a memory, so as to transmit and receive control signals and the like among the primary control unit 70 in the primary unit 5, the utilization control units 50*a*, 50*b*, and 50*c* in the utilization units 3*a*, 3*b*, and 3*c*, and the branching unit control units 60*a*, 60*b*, and 60*c*.

(6) Utilization Unit

The utilization units 3*a*, 3*b*, and 3*c* are installed by being embedded in or being suspended from a ceiling in an indoor space of a building or the like, or by being hung on a wall surface in the indoor space, or the like.

The utilization units 3*a*, 3*b*, and 3*c* are connected to the heat source unit 2 via the connection pipes 7, 8, and 9.

The utilization units 3*a*, 3*b*, and 3*c* respectively include the utilization circuits 13*a*, 13*b*, and 13*c* constituting part of the secondary refrigerant circuit 10.

The utilization units 3*a*, 3*b*, and 3*c* will be described hereinafter in terms of their configurations. The second utilization unit 3*b* and the third utilization unit 3*c* are configured similarly to the first utilization unit 3*a*. The configuration of only the first utilization unit 3*a* will thus be described herein. As to the configuration of each of the second utilization unit 3*b* and the third utilization unit 3*c*, elements will be denoted by reference signs obtained by replacing a subscript "a" in reference signs of elements of the first utilization unit 3*a* with a subscript "b" or "c", and these elements will not be described repeatedly.

The first utilization unit 3*a* principally includes the utilization circuit 13*a* described above, an indoor fan 53*a*, the utilization control unit 50*a*, and various sensors. The indoor fan 53*a* includes an indoor fan motor 54*a*.

The indoor fan 53*a* generates an air flow of sucking indoor air into the unit and supplying the indoor space with supply air obtained after heat exchange with the refrigerant flowing in the utilization heat exchanger 52*a*. The indoor fan 53*a* is driven by the indoor fan motor 54*a*.

The utilization unit 3*a* is provided with a liquid-side temperature sensor 58*a* configured to detect temperature of a refrigerant on the liquid side of the utilization heat exchanger 52*a*. The utilization unit 3*a* is further provided with an indoor temperature sensor 55*a* configured to detect indoor temperature as temperature of air introduced from the indoor space and to be subject to pass the utilization heat exchanger 52*a*.

The utilization control unit 50*a* controls behavior of the elements 51*a* and 53*a* (54*a*) of the utilization unit 3*a*. The utilization control unit 50*a* includes a processor such as a CPU or a microcomputer provided to control the utilization unit 3*a* and a memory, so as to transmit and receive control signals and the like to and from the remote controller (not depicted), and to transmit and receive control signals and the like among the heat source control unit 20 in the heat source unit 2, the branching unit control units 60*a*, 60*b*, and 60*c*, and the primary control unit 70 in the primary unit 5.

The second utilization unit 3*b* includes the utilization circuit 13*b*, an indoor fan 53*b*, the utilization control unit 50*b*, and an indoor fan motor 54*b*. The third utilization unit 3*c* includes the utilization circuit 13*c*, an indoor fan 53*c*, the utilization control unit 50*c*, and an indoor fan motor 54*c*.

(7) Branching Unit

The branching units 6*a*, 6*b*, and 6*c* are installed in a space behind the ceiling of the indoor space of the building or the like.

Each of the branching units 6*a*, 6*b*, and 6*c* is connected to a corresponding one of the utilization units 3*a*, 3*b*, and 3*c* one by one. The branching units 6*a*, 6*b*, and 6*c* are connected to the heat source unit 2 via the connection pipes 7, 8, and 9.

The branching units 6*a*, 6*b*, and 6*c* will be described next in terms of their configurations. The second branching unit 6*b* and the third branching unit 6*c* are configured similarly to the first branching unit 6*a*. The configuration of only the first branching unit 6*a* will thus be described herein. As to the configuration of each of the second branching unit 6*b* and the third branching unit 6*c*, elements will be denoted by reference signs obtained by replacing a subscript "a" in reference signs of elements of the first branching unit 6*a* with a subscript "b" or "c", and these elements will not be described repeatedly.

The first branching unit 6*a* principally includes the branching circuit 14*a* described above, and the branching unit control unit 60*a*.

The branching unit control unit 60*a* controls behavior of the elements 66*a* and 67*a* of the branching unit 6*a*. The branching unit control unit 60*a* includes a processor such as a CPU or a microcomputer provided to control the branching unit 6*a* and a memory, so as to transmit and receive control signals and the like to and from the remote controller (not depicted), and to transmit and receive control signals and the like among the heat source control unit 20 in the heat source unit 2, the utilization units 3*a*, 3*b*, and 3*c*, and the primary control unit 70 in the primary unit 5.

The second branching unit 6*b* includes the branching circuit 14*b*, and the branching unit control unit 60*b*. The third branching unit 6*c* includes the branching circuit 14*c*, and the branching unit control unit 60*c*.

(8) Control Unit

In the refrigeration cycle system 1, the heat source control unit 20, the utilization control units 50*a*, 50*b*, and 50*c*, the branching unit control units 60*a*, 60*b*, and 60*c*, and the primary control unit 70 described above are connected wiredly or wirelessly to be mutually communicable so as to constitute a control unit 80. The control unit 80 accordingly controls behavior of the elements 21 (21*a*), 22, 36, 44, 46*a*, 48*a*, 51*a*, 51*b*, 51*c*, 53*a*, 53*b*, 53*c* (54*a*, 54*b*, 54*c*), 66*a*, 66*b*, 66*c*, 67*a*, 67*b*, 67*c*, 71 (71*a*), 72, 75 (75*a*), 76, 102, and 104*a* in accordance with detection information of the various sensors 37, 38, 39, 83, 84, 85, 86, 87, 88, 77, 78, 79, 81, 82, 58*a*, 58*b*, 58*c*, and the like, command information received from the remote controller (not depicted), and the like.

(9) Behavior of Refrigeration Cycle System

Behavior of the refrigeration cycle system 1 will be described next with reference to FIG. 3 to FIG. 6.

Refrigeration cycle operation of the refrigeration cycle system 1 can be divided principally into cooling operation, heating operation, mainly cooling operation, and mainly heating operation.

Herein, cooling operation corresponds to refrigeration cycle operation in a case where there are only utilization units each of which operates with the utilization heat exchanger functioning as a refrigerant evaporator, and the cascade heat exchanger 35 functions as a radiator for the secondary refrigerant with respect to evaporation loads of all the utilization units.

Heating operation corresponds to refrigeration cycle operation in a case where there are only utilization units each of which operates with the utilization heat exchanger functioning as a refrigerant radiator, and the cascade heat exchanger 35 functions as an evaporator for the secondary refrigerant with respect to radiation loads of all the utilization units.

During mainly cooling operation, there coexist a utilization unit operating with the utilization heat exchanger functioning as a refrigerant evaporator and a utilization unit operating with the utilization heat exchanger functioning as a refrigerant radiator. Mainly cooling operation corresponds to refrigeration cycle operation in a case where the cascade heat exchanger 35 functions as a radiator for the secondary refrigerant with respect to evaporation loads of all the utilization units principally occupying heat loads of all the utilization units.

During mainly heating operation, there coexist a utilization unit operating with the utilization heat exchanger functioning as a refrigerant evaporator, and a utilization unit operating with the utilization heat exchanger functioning as a refrigerant radiator. Mainly heating operation corresponds to refrigeration cycle operation in a case where the cascade heat exchanger 35 functions as an evaporator for the secondary refrigerant with respect to radiation loads of all the utilization units principally occupying heat loads of all the utilization units.

Behavior of the refrigeration cycle system 1 including these types of refrigeration cycle operation is executed by the control unit 80.

(9-1) Cooling Operation

Figure 3:
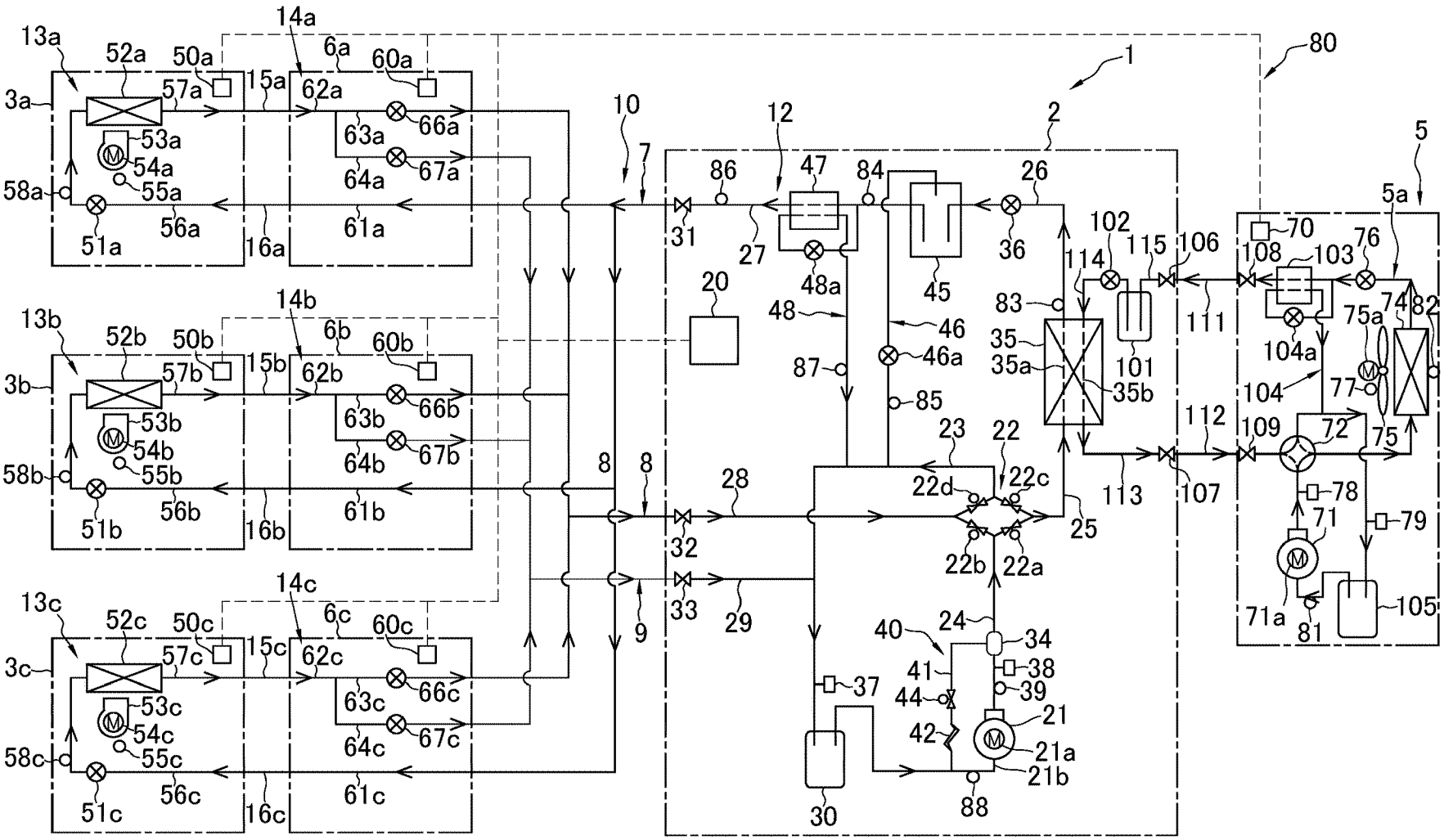
FIG. 3 is a view indicating behavior (a refrigerant flow) during cooling operation of the refrigeration cycle system.

During cooling operation, for example, each of the utilization heat exchangers 52*a*, 52*b*, and 52*c* in the utilization units 3*a*, 3*b*, and 3*c* functions as a refrigerant evaporator, and the cascade heat exchanger 35 functions as a radiator for the secondary refrigerant. During such cooling operation, the primary refrigerant circuit 5*a* and the secondary refrigerant circuit 10 in the refrigeration cycle system 1 are configured as depicted in FIG. 3. FIG. 3 includes arrows provided to the primary refrigerant circuit 5*a* and arrows provided to the secondary refrigerant circuit 10, which indicate refrigerant flows during cooling operation.

Specifically, in the primary unit 5, the primary switching mechanism 72 is switched into the fifth connection state to cause the cascade heat exchanger 35 to function as an evaporator for the primary refrigerant. The fifth connection state of the primary switching mechanism 72 is depicted by solid lines in the primary switching mechanism 72 in FIG. 3. Accordingly in the primary unit 5, the primary refrigerant discharged from the primary compressor 71 passes the primary switching mechanism 72 and exchanges heat with outdoor air supplied from the primary fan 75 in the primary heat exchanger 74 to be condensed. The primary refrigerant condensed in the primary heat exchanger 74 passes the primary first expansion valve 76 controlled into a fully opened state, and part of the refrigerant flows toward the first liquid shutoff valve 108 via the primary subcooling heat exchanger 103, and another part of the refrigerant branches into the primary subcooling circuit 104. The refrigerant flowing in the primary subcooling circuit 104 is decompressed while passing the primary subcooling expansion valve 104*a*. The refrigerant flowing from the primary first expansion valve 76 toward the first liquid shutoff valve 108 exchanges heat, in the primary subcooling heat exchanger 103, with the refrigerant decompressed at the primary subcooling expansion valve 104*a* and flowing in the primary subcooling circuit 104, so as to be cooled into a subcooled state. The refrigerant brought into the subcooled state flows in the order of the primary first connection pipe 111, the second liquid shutoff valve 106, and the first connecting pipe 115 to flow into the primary receiver 101. The primary receiver 101 reserves an excessive liquid refrigerant in the refrigeration cycle in the primary refrigerant circuit 5*a*. The refrigerant having flowed from the primary receiver 101 to the third connecting pipe 114 is decompressed at the primary second expansion valve 102. In this case, the valve opening degree of the primary second expansion valve 102 is controlled such that, for example, the refrigerant sucked into the primary compressor 71 has a degree of superheating at a predetermined value. The primary refrigerant decompressed at the primary second expansion valve 102 exchanges heat with the secondary refrigerant flowing in the secondary flow path 35*a* to be evaporated while flowing in the primary flow path 35*b* of the cascade heat exchanger 35, and flows toward the second gas shutoff valve 107 via the second connecting pipe 113. The refrigerant having passed the second gas shutoff valve 107 passes the primary second connection pipe 112 and the first gas shutoff valve 109 to reach the primary switching mechanism 72. The refrigerant having passed the primary switching mechanism 72 joins the refrigerant having flowed in the primary subcooling circuit 104, and is then sucked into the primary compressor 71 via the primary accumulator 105.

In the heat source unit 2, the secondary switching mechanism 22 is switched into the first connection state as well as the fourth connection state to cause the cascade heat exchanger 35 to function as a radiator for the secondary refrigerant. In the first connection state of the secondary switching mechanism 22, the first switching valve 22*a* is in the opened state and the third switching valve 22*c* is in the closed state. In the fourth connection state of the secondary switching mechanism 22, the fourth switching valve 22*d* is in the opened state and the second switching valve 22*b* is in the closed state. The heat source expansion valve 36 is controlled in opening degree. In the first to third utilization units 3*a*, 3*b*, and 3*c*, the first control valves 66*a*, 66*b*, and 66*c* and the second control valves 67*a*, 67*b*, and 67*c* are controlled into the opened state. Accordingly, each of the utilization heat exchangers 52*a*, 52*b*, and 52*c* in the utilization units 3*a*, 3*b*, and 3*c* functions as a refrigerant evaporator. All the utilization heat exchangers 52*a*, 52*b*, and 52*c* in the utilization units 3*a*, 3*b*, and 3*c* and the suction side of the secondary compressor 21 in the heat source unit 2 are connected via the first utilization pipes 57*a*, 57*b*, and 57*c*, the first connecting tubes 15*a*, 15*b*, and 15*c*, the junction pipes 62*a*, 62*b*, and 62*c*, the first branching pipes 63*a*, 63*b*, and 63*c*, the second branching pipes 64*a*, 64*b*, and 64*c*, the secondary first connection pipe 8, and the secondary second connection pipe 9. The secondary subcooling expansion valve 48*a* is controlled in opening degree such that the secondary refrigerant flowing at the outlet of the secondary subcooling heat exchanger 47 toward the secondary third connection pipe 7 has a degree of subcooling at a predetermined value. The bypass expansion valve 46*a* is controlled into the closed state. In the utilization units 3*a*, 3*b*, and 3*c*, the utilization expansion valves 51*a*, 51*b*, and 51*c* are each controlled in opening degree.

In the secondary refrigerant circuit 10 in this state, a secondary high-pressure refrigerant compressed in and discharged from the secondary compressor 21 is sent to the secondary flow path 35*a* of the cascade heat exchanger 35 via the secondary switching mechanism 22. The secondary high-pressure refrigerant flowing in the secondary flow path 35*a* of the cascade heat exchanger 35 radiates heat, and the primary refrigerant flowing in the primary flow path 35*b* of the cascade heat exchanger 35 is evaporated. The secondary refrigerant having radiated heat in the cascade heat exchanger 35 passes the heat source expansion valve 36 controlled in opening degree, and then flows into the secondary receiver 45. Part of the refrigerant having flowed out of the secondary receiver 45 branches into the secondary subcooling circuit 48, is decompressed at the secondary subcooling expansion valve 48*a*, and then joins into the suction flow path 23. In the secondary subcooling heat exchanger 47, another part of the refrigerant having flowed out of the secondary receiver 45 is cooled by the refrigerant flowing in the secondary subcooling circuit 48, and is then sent to the secondary third connection pipe 7 via the third shutoff valve 31.

The refrigerant sent to the secondary third connection pipe 7 is branched into three portions to pass the third branching pipes 61*a*, 61*b*, and 61*c* of the first to third branching units 6*a*, 6*b*, and 6*c*. Thereafter, the refrigerant having flowed in the second connecting tubes 16*a*, 16*b*, and 16*c* is sent to the second utilization pipes 56*a*, 56*b*, and 56*c* of the first to third utilization units 3*a*, 3*b*, and 3*c*. The refrigerant sent to the second utilization pipes 56*a*, 56*b*, and 56*c* is sent to the utilization expansion valves 51*a*, 51*b*, and 51*c* in the utilization units 3*a*, 3*b*, and 3*c*.

The refrigerant having passed the utilization expansion valves 51*a*, 51*b*, and 51*c* each controlled in opening degree exchanges heat with indoor air supplied by the indoor fans 53*a*, 53*b*, and 53*c* in the utilization heat exchangers 52*a*, 52*b*, and 52*c*. The refrigerant flowing in the utilization heat exchangers 52*a*, 52*b*, and 52*c* is thus evaporated into a low-pressure gas refrigerant. Indoor air is cooled and is supplied into the indoor space. The indoor space is thus cooled. The low-pressure gas refrigerant evaporated in the utilization heat exchangers 52*a*, 52*b*, and 52*c* flows in the first utilization pipes 57*a*, 57*b*, and 57*c*, flows in the first connecting tubes 15*a*, 15*b*, and 15*c*, and is then sent to the junction pipes 62*a*, 62*b*, and 62*c* of the first to third branching units 6*a*, 6*b*, and 6*c*.

The low-pressure gas refrigerant sent to the junction pipes 62*a*, 62*b*, and 62*c* is branched into the first branching pipes 63*a*, 63*b*, and 63*c*, and the second branching pipes 64*a*, 64*b*, and 64*c*. The refrigerant having passed the first control valves 66*a*, 66*b*, and 66*c* on the first branching pipes 63*a*, 63*b*, and 63*c* is sent to the secondary first connection pipe 8. The refrigerant having passed the second control valves 67*a*, 67*b*, and 67*c* on the second branching pipes 64*a*, 64*b*, and 64*c* is sent to the secondary second connection pipe 9.

The low-pressure gas refrigerant sent to the secondary first connection pipe 8 and the secondary second connection pipe 9 is returned to the suction side of the secondary compressor 21 via the first shutoff valve 32, the second shutoff valve 33, the first heat source pipe 28, the second heat source pipe 29, the secondary switching mechanism 22, the suction flow path 23, and the secondary accumulator 30.

Behavior during cooling operation is executed in this manner.

(9-2) Heating Operation

Figure 4:
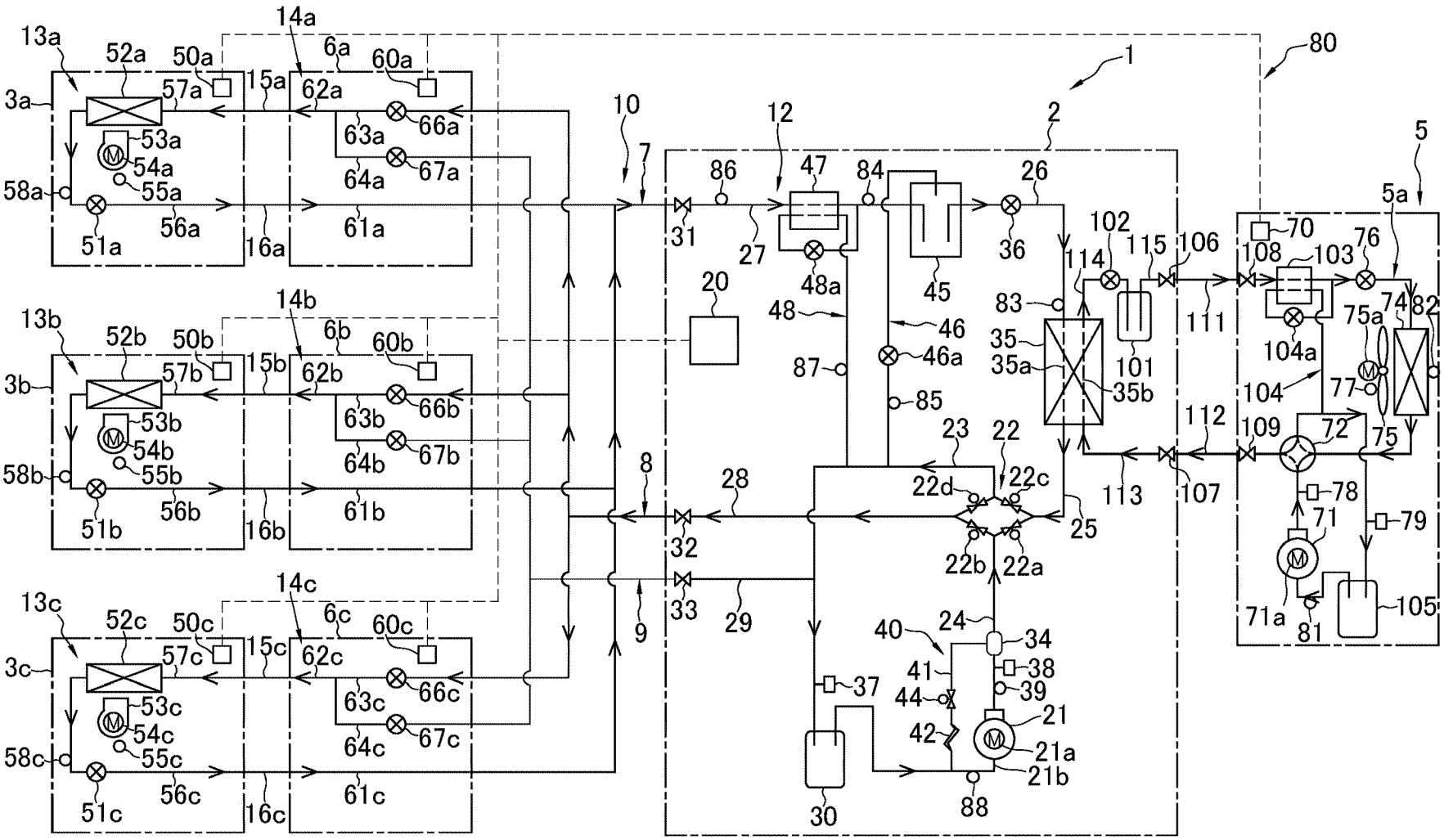
FIG. 4 is a view indicating behavior (a refrigerant flow) during heating operation of the refrigeration cycle system.

During heating operation, for example, each of the utilization heat exchangers 52*a*, 52*b*, and 52*c* in the utilization units 3*a*, 3*b*, and 3*c* functions as a refrigerant radiator. Furthermore, during heating operation, the cascade heat exchanger 35 functions as an evaporator for the secondary refrigerant. During heating operation, the primary refrigerant circuit 5*a* and the secondary refrigerant circuit 10 in the refrigeration cycle system 1 are configured as depicted in FIG. 4. FIG. 4 includes arrows provided to the primary refrigerant circuit 5*a* and arrows provided to the secondary refrigerant circuit 10, which indicate refrigerant flows during heating operation.

Specifically, in the primary unit 5, the primary switching mechanism 72 is switched into a sixth connecting state to cause the cascade heat exchanger 35 to function as a radiator for the primary refrigerant. The sixth connecting state of the primary switching mechanism 72 corresponds to a connection state depicted by broken lines in the primary switching mechanism 72 in FIG. 4. Accordingly in the primary unit 5, the primary refrigerant discharged from the primary compressor 71, having passed the primary switching mechanism 72 and the first gas shutoff valve 109 passes the primary second connection pipe 112 and the second gas shutoff valve 107 to be sent to the primary flow path 35*b* of the cascade heat exchanger 35. The refrigerant flowing in the primary flow path 35*b* of the cascade heat exchanger 35 exchanges heat with the secondary refrigerant flowing in the secondary flow path 35*a* to be condensed. The primary refrigerant condensed in the cascade heat exchanger 35 passes the primary second expansion valve 102 controlled into the fully opened state while flowing in the third connecting pipe 114, and flows into the primary receiver 101. The primary receiver 101 reserves an excessive liquid refrigerant in the refrigeration cycle in the primary refrigerant circuit 5*a*. The refrigerant having flowed out of the primary receiver 101 flows in the order of the first connecting pipe 115, the second liquid shutoff valve 106, the primary first connection pipe 111, the first liquid shutoff valve 108, and the primary subcooling heat exchanger 103, and is decompressed at the primary first expansion valve 76. During heating operation, the primary subcooling expansion valve 104*a* is controlled into the closed state. Accordingly, the refrigerant does not flow to the primary subcooling circuit 104 and does not exchange heat in the primary subcooling heat exchanger 103. The valve opening degree of the primary first expansion valve 76 is controlled such that, for example, the refrigerant sucked into the primary compressor 71 has a degree of superheating at a predetermined valve. The refrigerant decompressed at the primary first expansion valve 76 exchanges heat with outdoor air supplied from the primary fan 75 in the primary heat exchanger 74 to be evaporated, and is sucked into the primary compressor 71 via the primary switching mechanism 72 and the primary accumulator 105.

In the heat source unit 2, the secondary switching mechanism 22 is switched into the second connection state as well as the third connection state. The cascade heat exchanger 35 thus functions as an evaporator for the secondary refrigerant. In the second connection state of the secondary switching mechanism 22, the first switching valve 22*a* is in the closed state and the third switching valve 22*c* is in the opened state. In the third connection state of the secondary switching mechanism 22, the second switching valve 22*b* is in the opened state and the fourth switching valve 22*d* is in the closed state. The heat source expansion valve 36 is controlled in opening degree. In the first to third branching units 6*a*, 6*b*, and 6*c*, the first control valves 66*a*, 66*b*, and 66*c* are controlled into the opened state, and the second control valves 67*a*, 67*b*, and 67*c* are controlled into the closed state. Accordingly, each of the utilization heat exchangers 52*a*, 52*b*, and 52*c* in the utilization units 3*a*, 3*b*, and 3*c* functions as a refrigerant radiator. The utilization heat exchangers 52*a*, 52*b*, and 52*c* in the utilization units 3*a*, 3*b*, and 3*c* and the discharge side of the secondary compressor 21 in the heat source unit 2 are connected via the discharge flow path 24, the first heat source pipe 28, the secondary first connection pipe 8, the first branching pipes 63*a*, 63*b*, and 63*c*, the junction pipes 62*a*, 62*b*, and 62*c*, the first connecting tubes 15*a*, 15*b*, and 15*c*, and the first utilization pipes 57*a*, 57*b*, and 57*c*. The secondary subcooling expansion valve 48*a* and the bypass expansion valve 46*a* are controlled into the closed state. In the utilization units 3*a*, 3*b*, and 3*c*, the utilization expansion valves 51*a*, 51*b*, and 51*c* are each controlled in opening degree.

In the secondary refrigerant circuit 10 in this state, a high-pressure refrigerant compressed in and discharged from the secondary compressor 21 is sent to the first heat source pipe 28 via the second switching valve 22*b* controlled into the opened state in the secondary switching mechanism 22. The refrigerant sent to the first heat source pipe 28 is sent to the secondary first connection pipe 8 via the first shutoff valve 32.

The high-pressure refrigerant sent to the secondary first connection pipe 8 is branched into three portions to be sent to the first branching pipes 63*a*, 63*b*, and 63*c* in the utilization units 3*a*, 3*b*, and 3*c* in operation. The high-pressure refrigerant sent to the first branching pipes 63*a*, 63*b*, and 63*c* passes the first control valves 66*a*, 66*b*, and 66*c*, and flows in the junction pipes 62*a*, 62*b*, and 62*c*. The refrigerant having flowed in the first connecting tubes 15*a*, 15*b*, and 15*c* and the first utilization pipes 57*a*, 57*b*, and 57*c* is then sent to the utilization heat exchangers 52*a*, 52*b*, and 52*c*.

The high-pressure refrigerant sent to the utilization heat exchangers 52*a*, 52*b*, and 52*c* exchanges heat with indoor air supplied by the indoor fans 53*a*, 53*b*, and 53*c* in the utilization heat exchangers 52*a*, 52*b*, and 52*c*. The refrigerant flowing in the utilization heat exchangers 52*a*, 52*b*, and 52*c* thus radiates heat. Indoor air is heated and is supplied into the indoor space. The indoor space is thus heated. The refrigerant having radiated heat in the utilization heat exchangers 52*a*, 52*b*, and 52*c* flows in the second utilization pipes 56*a*, 56*b*, and 56*c* and passes the utilization expansion valves 51*a*, 51*b*, and 51*c* each controlled in opening degree. Thereafter, the refrigerant having flowed in the second connecting tubes 16*a*, 16*b*, and 16*c* flows in the third branching pipes 61*a*, 61*b*, and 61*c* of the branching units 6*a*, 6*b*, and 6*c*.

The refrigerant sent to the third branching pipes 61*a*, 61*b*, and 61*c* is sent to the secondary third connection pipe 7 to join.

The refrigerant sent to the secondary third connection pipe 7 is sent to the heat source expansion valve 36 via the third shutoff valve 31. The refrigerant sent to the heat source expansion valve 36 is controlled in flow rate at the heat source expansion valve 36 and is then sent to the cascade heat exchanger 35. In the cascade heat exchanger 35, the secondary refrigerant flowing in the secondary flow path 35*a* is evaporated into a low-pressure gas refrigerant and is sent to the secondary switching mechanism 22, and the primary refrigerant flowing in the primary flow path 35*b* of the cascade heat exchanger 35 is condensed. The secondary low-pressure gas refrigerant sent to the secondary switching mechanism 22 is returned to the suction side of the secondary compressor 21 via the suction flow path 23 and the secondary accumulator 30.

Behavior during heating operation is executed in this manner.

(9-3) Mainly Cooling Operation

Figure 5:
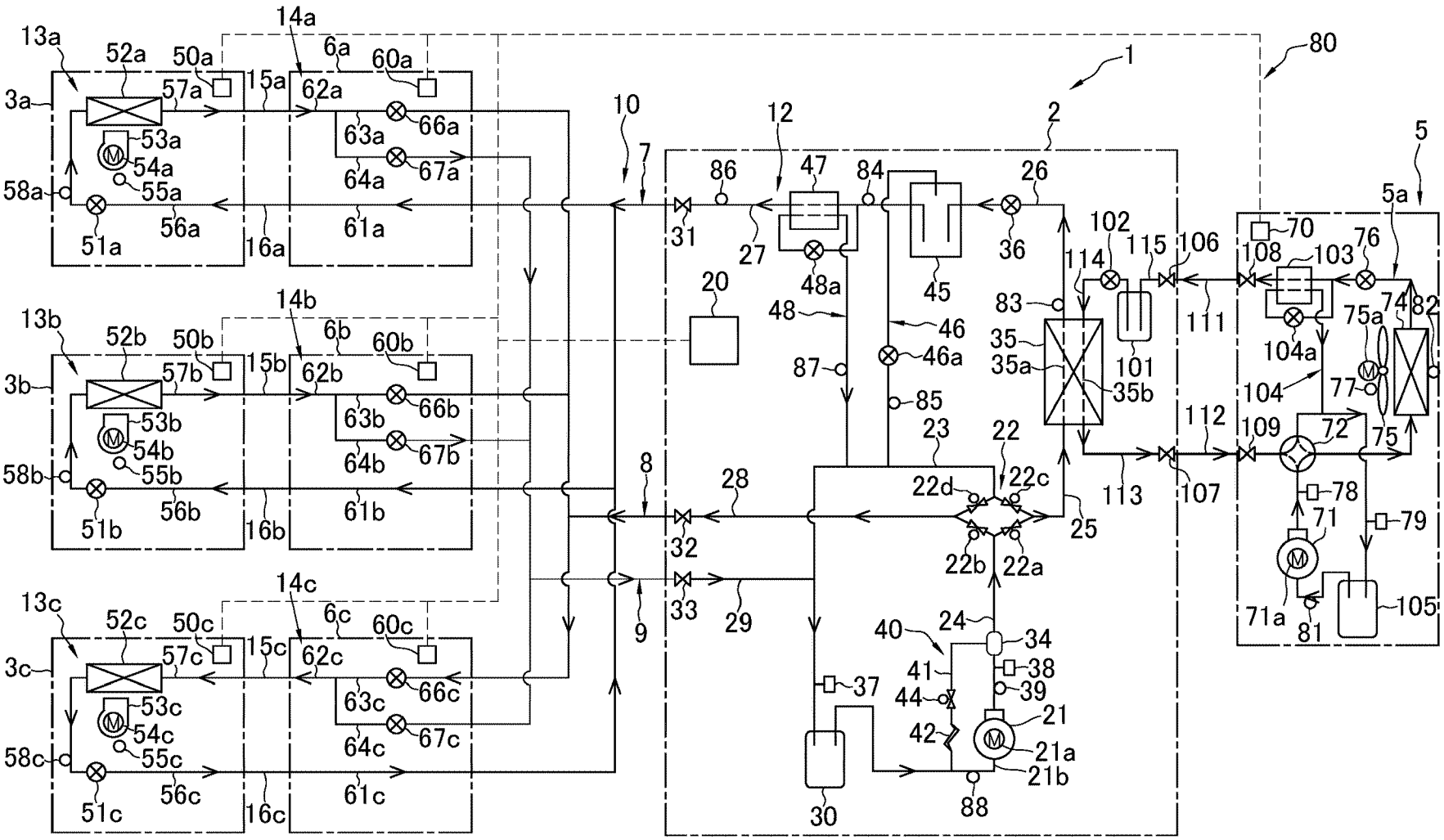
FIG. 5 is a view indicating behavior (a refrigerant flow) during simultaneous cooling and heating operation (mainly cooling) of the refrigeration cycle system.

During mainly cooling operation, for example, the utilization heat exchangers 52*a* and 52*b* in the utilization units 3*a* and 3*b* each function as a refrigerant evaporator, and the utilization heat exchanger 52*c* in the utilization unit 3*c* functions as a refrigerant radiator. During mainly cooling operation, the cascade heat exchanger 35 functions as a radiator for the secondary refrigerant. During mainly cooling operation, the primary refrigerant circuit 5*a* and the secondary refrigerant circuit 10 in the refrigeration cycle system 1 are configured as depicted in FIG. 5. FIG. 5 includes arrows provided to the primary refrigerant circuit 5*a* and arrows provided to the secondary refrigerant circuit 10, which indicate refrigerant flows during mainly cooling operation.

Specifically, in the primary unit 5, the primary switching mechanism 72 is switched into the fifth connection state (the state depicted by solid lines in the primary switching mechanism 72 in FIG. 5) to cause the cascade heat exchanger 35 to function as an evaporator for the primary refrigerant. Accordingly in the primary unit 5, the primary refrigerant discharged from the primary compressor 71 passes the primary switching mechanism 72 and exchanges heat with outdoor air supplied from the primary fan 75 in the primary heat exchanger 74 to be condensed. The primary refrigerant condensed in the primary heat exchanger 74 passes the primary first expansion valve 76 controlled into a fully opened state, and part of the refrigerant flows toward the first liquid shutoff valve 108 via the primary subcooling heat exchanger 103, and another part of the refrigerant branches into the primary subcooling circuit 104. The refrigerant flowing in the primary subcooling circuit 104 is decompressed while passing the primary subcooling expansion valve 104*a*. The refrigerant flowing from the primary first expansion valve 76 toward the first liquid shutoff valve 108 exchanges heat, in the primary subcooling heat exchanger 103, with the refrigerant decompressed at the primary subcooling expansion valve 104*a* and flowing in the primary subcooling circuit 104, so as to be cooled into a subcooled state. The refrigerant brought into the subcooled state flows in the order of the primary first connection pipe 111, the second liquid shutoff valve 106, and the first connecting pipe 115 to flow into the primary receiver 101. The primary receiver 101 reserves an excessive liquid refrigerant in the refrigeration cycle in the primary refrigerant circuit 5*a*. The refrigerant having flowed from the primary receiver 101 to the third connecting pipe 114 is decompressed at the primary second expansion valve 102. In this case, the valve opening degree of the primary second expansion valve 102 is controlled such that, for example, the refrigerant sucked into the primary compressor 71 has a degree of superheating at a predetermined valve. The primary refrigerant decompressed at the primary second expansion valve 102 exchanges heat with the secondary refrigerant flowing in the secondary flow path 35*a* to be evaporated while flowing in the primary flow path 35*b* of the cascade heat exchanger 35, and flows toward the second gas shutoff valve 107 via the second connecting pipe 113. The refrigerant having passed the second gas shutoff valve 107 passes the primary second connection pipe 112 and the first gas shutoff valve 109 to reach the primary switching mechanism 72. The refrigerant having passed the primary switching mechanism 72 joins the refrigerant having flowed in the primary subcooling circuit 104, and is then sucked into the primary compressor 71 via the primary accumulator 105.

In the heat source unit 2, the secondary switching mechanism 22 is switched into the first connection state (the first switching valve 22*a* is in the opened state and the third switching valve 22*c* is in the closed state) as well as the third connection state (the second switching valve 22*b* is in the opened state and the fourth switching valve 22*d* is in the closed state) to cause the cascade heat exchanger 35 to function as a radiator for the secondary refrigerant. The heat source expansion valve 36 is controlled in opening degree. In the first to third branching units 6*a*, 6*b*, and 6*c*, the first control valve 66*c* and the second control valves 67*a* and 67*b* are controlled into the opened state, and the first control valves 66*a* and 66*b* and the second control valve 67*c* are controlled into the closed state. Accordingly, the utilization heat exchangers 52*a* and 52*b* in the utilization units 3*a* and 3*b* each function as a refrigerant evaporator, and the utilization heat exchanger 52*c* in the utilization unit 3*c* functions as a refrigerant radiator. The utilization heat exchangers 52*a* and 52*b* in the utilization units 3*a* and 3*b* and the suction side of the secondary compressor 21 in the heat source unit 2 are connected via the secondary second connection pipe 9, and the utilization heat exchanger 52*c* in the utilization unit 3*c* and the discharge side of the secondary compressor 21 in the heat source unit 2 are connected via the secondary first connection pipe 8. The secondary subcooling expansion valve 48*a* is controlled in opening degree such that the secondary refrigerant flowing at the outlet of the secondary subcooling heat exchanger 47 toward the secondary third connection pipe 7 has a degree of subcooling at a predetermined value. The bypass expansion valve 46*a* is controlled into the closed state. In the utilization units 3*a*, 3*b*, and 3*c*, the utilization expansion valves 51*a*, 51*b*, and 51*c* are each controlled in opening degree.

In the secondary refrigerant circuit 10 in this state, part of the secondary high-pressure refrigerant compressed in and discharged from the secondary compressor 21 is sent to the secondary first connection pipe 8 via the secondary switching mechanism 22, the first heat source pipe 28, and the first shutoff valve 32, and the remaining is sent to the secondary flow path 35*a* of the cascade heat exchanger 35 via the secondary switching mechanism 22 and the third heat source pipe 25.

The high-pressure refrigerant sent to the secondary first connection pipe 8 is sent to the first branching pipe 63*c*. The high-pressure refrigerant sent to the first branching pipe 63*c* is sent to the utilization heat exchanger 52*c* in the utilization unit 3*c* via the first control valve 66*c* and the junction pipe 62*c*.

The high-pressure refrigerant sent to the utilization heat exchanger 52*c* exchanges heat with indoor air supplied by the indoor fan 53*c* in the utilization heat exchanger 52*c*. The refrigerant flowing in the utilization heat exchanger 52*c* thus radiates heat. Indoor air is heated and is supplied into the indoor space, and the utilization unit 3*c* executes heating operation. The refrigerant having radiated heat in the utilization heat exchanger 52*c* flows in the second utilization pipe 56*c* and is controlled in flow rate at the utilization expansion valve 51*c*. The refrigerant having flowed in the second connecting tube 16*c* is sent to the third branching pipe 61*c* in the branching unit 6*c*.

The refrigerant sent to the third branching pipe 61*c* is sent to the secondary third connection pipe 7.

The high-pressure refrigerant sent to the secondary flow path 35*a* of the cascade heat exchanger 35 exchanges heat with the primary refrigerant flowing in the primary flow path 35*b* in the cascade heat exchanger 35 to radiate heat. The secondary refrigerant having radiated heat in the cascade heat exchanger 35 is controlled in flow rate at the heat source expansion valve 36 and then flows into the secondary receiver 45. Part of the refrigerant having flowed out of the secondary receiver 45 branches into the secondary subcooling circuit 48, is decompressed at the secondary subcooling expansion valve 48*a*, and then joins into the suction flow path 23. In the secondary subcooling heat exchanger 47, another part of the refrigerant having flowed out of the secondary receiver 45 is cooled by the refrigerant flowing in the secondary subcooling circuit 48, is then sent to the secondary third connection pipe 7 via the third shutoff valve 31, and joins the refrigerant having radiated heat in the utilization heat exchanger 52*c*.

The refrigerant having joined in the secondary third connection pipe 7 is branched into two portions to be sent to the third branching pipes 61*a* and 61*b* of the branching units 6*a* and 6*b*. Thereafter, the refrigerant having flowed in the second connecting tubes 16*a* and 16*b* is sent to the second utilization pipes 56*a* and 56*b* of the first and second utilization units 3*a* and 3*b*. The refrigerant flowing in the second utilization pipes 56*a* and 56*b* passes the utilization expansion valves 51*a* and 51*b* in the utilization units 3*a* and 3*b*.

The refrigerant having passed the utilization expansion valves 51*a* and 51*b* each controlled in opening degree exchanges heat with indoor air supplied by the indoor fans 53*a* and 53*b* in the utilization heat exchangers 52*a* and 52*b*. The refrigerant flowing in the utilization heat exchangers 52*a* and 52*b* is thus evaporated into a low-pressure gas refrigerant. Indoor air is cooled and is supplied into the indoor space. The indoor space is thus cooled. The low-pressure gas refrigerant evaporated in the utilization heat exchangers 52*a* and 52*b* is sent to the junction pipes 62*a* and 62*b* of the first and second branching units 6*a* and 6*b*.

The low-pressure gas refrigerant sent to the junction pipes 62*a* and 62*b* is sent to the secondary second connection pipe 9 via the second control valves 67*a* and 67*b* and the second branching pipes 64*a* and 64*b*, to join.

The low-pressure gas refrigerant sent to the secondary second connection pipe 9 is returned to the suction side of the secondary compressor 21 via the second shutoff valve 33, the second heat source pipe 29, the suction flow path 23, and the secondary accumulator 30.

Behavior during mainly cooling operation is executed in this manner.

(9-4) Mainly Heating Operation

Figure 6:
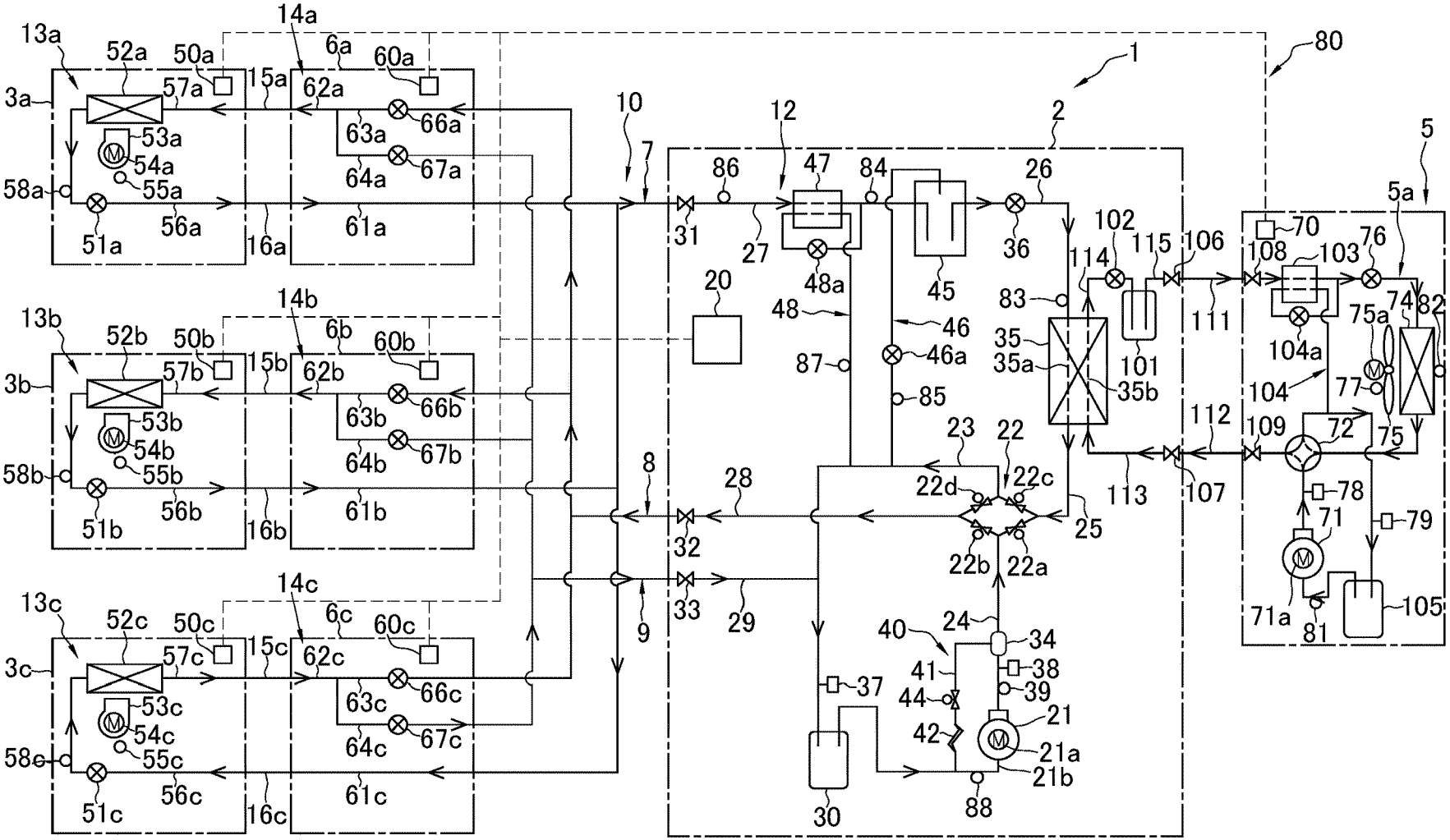
FIG. 6 is a view indicating behavior (a refrigerant flow) during simultaneous cooling and heating operation (mainly heating) of the refrigeration cycle system.

During mainly heating operation, for example, the utilization heat exchangers 52*a* and 52*b* in the utilization units 3*a* and 3*b* each function as a refrigerant radiator, and the utilization heat exchanger 52*c* functions as a refrigerant evaporator. During mainly heating operation, the cascade heat exchanger 35 functions as an evaporator for the secondary refrigerant. During mainly heating operation, the primary refrigerant circuit 5*a* and the secondary refrigerant circuit 10 in the refrigeration cycle system 1 are configured as depicted in FIG. 6. FIG. 6 includes arrows provided to the primary refrigerant circuit 5*a* and arrows provided to the secondary refrigerant circuit 10, which indicate refrigerant flows during mainly heating operation.

Specifically, in the primary unit 5, the primary switching mechanism 72 is switched into a sixth connecting state to cause the cascade heat exchanger 35 to function as a radiator for the primary refrigerant. The sixth connecting state of the primary switching mechanism 72 corresponds to a connection state depicted by broken lines in the primary switching mechanism 72 in FIG. 6. Accordingly in the primary unit 5, the primary refrigerant discharged from the primary compressor 71, having passed the primary switching mechanism 72 and the first gas shutoff valve 109 passes the primary second connection pipe 112 and the second gas shutoff valve 107 to be sent to the primary flow path 35*b* of the cascade heat exchanger 35. The refrigerant flowing in the primary flow path 35*b* of the cascade heat exchanger 35 exchanges heat with the secondary refrigerant flowing in the secondary flow path 35*a* to be condensed. The primary refrigerant condensed in the cascade heat exchanger 35 passes the primary second expansion valve 102 controlled into the fully opened state while flowing in the third connecting pipe 114, and flows into the primary receiver 101. The primary receiver 101 reserves an excessive liquid refrigerant in the refrigeration cycle in the primary refrigerant circuit 5*a*. The refrigerant having flowed out of the primary receiver 101 flows in the order of the first connecting pipe 115, the second liquid shutoff valve 106, the primary first connection pipe 111, the first liquid shutoff valve 108, and the primary subcooling heat exchanger 103, and is decompressed at the primary first expansion valve 76. During mainly heating operation, the primary subcooling expansion valve 104*a* is controlled into the closed state. Accordingly, the refrigerant does not flow to the primary subcooling circuit 104 and does not exchange heat in the primary subcooling heat exchanger 103. The valve opening degree of the primary first expansion valve 76 is controlled such that, for example, the refrigerant sucked into the primary compressor 71 has a degree of superheating at a predetermined valve. The refrigerant decompressed at the primary first expansion valve 76 exchanges heat with outdoor air supplied from the primary fan 75 in the primary heat exchanger 74 to be evaporated, and is sucked into the primary compressor 71 via the primary switching mechanism 72 and the primary accumulator 105.

In the heat source unit 2, the secondary switching mechanism 22 is switched into the second connection state as well as the third connection state. In the second connection state of the secondary switching mechanism 22, the first switching valve 22*a* is in the closed state and the third switching valve 22*c* is in the opened state. In the third connection state of the secondary switching mechanism 22, the second switching valve 22*b* is in the opened state and the fourth switching valve 22*d* is in the closed state. The cascade heat exchanger 35 thus functions as an evaporator for the secondary refrigerant. The heat source expansion valve 36 is controlled in opening degree. In the first to third branching units 6*a*, 6*b*, and 6*c*, the first control valves 66*a* and 66*b* and the second control valve 67*c* are controlled into the opened state, and the first control valve 66*c* and the second control valves 67*a* and 67*b* are controlled into the closed state. Accordingly, the utilization heat exchangers 52*a* and 52*b* in the utilization units 3*a* and 3*b* each function as a refrigerant radiator, and the utilization heat exchanger 52*c* in the utilization unit 3*c* functions as a refrigerant evaporator. The utilization heat exchanger 52*c* in the utilization unit 3*c* and the suction side of the secondary compressor 21 in the heat source unit 2 are connected via the first utilization pipe 57*c*, the first connecting tube 15*c*, the junction pipe 62*c*, the second branching pipe 64*c*, and the secondary second connection pipe 9. The utilization heat exchangers 52*a* and 52*b* in the utilization units 3*a* and 3*b* and the discharge side of the secondary compressor 21 in the heat source unit 2 are connected via the discharge flow path 24, the first heat source pipe 28, the secondary first connection pipe 8, the first branching pipes 63*a* and 63*b*, the junction pipes 62*a* and 62*b*, the first connecting tubes 15*a* and 15*b*, and the first utilization pipes 57*a* and 57*b*. The secondary subcooling expansion valve 48*a* and the bypass expansion valve 46*a* are controlled into the closed state. In the utilization units 3*a*, 3*b*, and 3*c*, the utilization expansion valves 51*a*, 51*b*, and 51*c* are each controlled in opening degree.

In the secondary refrigerant circuit 10 in this state, a secondary high-pressure refrigerant compressed in and discharged from the secondary compressor 21 is sent to the secondary first connection pipe 8 via the secondary switching mechanism 22, the first heat source pipe 28, and the first shutoff valve 32.

The high-pressure refrigerant sent to the secondary first connection pipe 8 is branched into two portions to be sent to the first branching pipes 63*a* and 63*b* of the first branching unit 6*a* and the second branching unit 6*b* respectively connected to the first utilization unit 3*a* and the second utilization unit 3*b* in operation. The high-pressure refrigerant sent to the first branching pipes 63*a* and 63*b* is sent to the utilization heat exchangers 52*a* and 52*b* in the first utilization unit 3*a* and the second utilization unit 3*b* via the first control valves 66*a* and 66*b*, the junction pipes 62*a* and 62*b*, and the first connecting tubes 15*a* and 15*b*.

The high-pressure refrigerant sent to the utilization heat exchangers 52*a* and 52*b* exchanges heat with indoor air supplied by the indoor fans 53*a* and 53*b* in the utilization heat exchangers 52*a* and 52*b*. The refrigerant flowing in the utilization heat exchangers 52*a* and 52*b* thus radiates heat. Indoor air is heated and is supplied into the indoor space. The indoor space is thus heated. The refrigerant having radiated heat in the utilization heat exchangers 52*a* and 52*b* flows in the second utilization pipes 56*a* and 56*b*, and passes the utilization expansion valves 51*a* and 51*b* each controlled in opening degree. Thereafter, the refrigerant having flowed in the second connecting tubes 16*a* and 16*b* is sent to the secondary third connection pipe 7 via the third branching pipes 61*a* and 61*b* of the branching units 6*a* and 6*b*.

Part of the refrigerant sent to the secondary third connection pipe 7 is sent to the third branching pipe 61*c* of the branching unit 6*c*, and the remaining is sent to the heat source expansion valve 36 via the third shutoff valve 31.

The refrigerant sent to the third branching pipe 61*c* flows in the second utilization pipe 56*c* of the utilization unit 3*c* via the second connecting tube 16*c*, and is sent to the utilization expansion valve 51*c*.

The refrigerant having passed the utilization expansion valve 51*c* controlled in opening degree exchanges heat with indoor air supplied by the indoor fan 53*c* in the utilization heat exchanger 52*c*. The refrigerant flowing in the utilization heat exchanger 52*c* is thus evaporated into a low-pressure gas refrigerant. Indoor air is cooled and is supplied into the indoor space. The indoor space is thus cooled. The low-pressure gas refrigerant evaporated in the utilization heat exchanger 52*c* passes the first utilization pipe 57*c* and the first connecting tube 15*c* to be sent to the junction pipe 62*c*.

The low-pressure gas refrigerant sent to the junction pipe 62*c* is sent to the secondary second connection pipe 9 via the second control valve 67*c* and the second branching pipe 64*c*.

The low-pressure gas refrigerant sent to the secondary second connection pipe 9 is returned to the suction side of the secondary compressor 21 via the second shutoff valve 33, the second heat source pipe 29, the suction flow path 23, and the secondary accumulator 30.

The refrigerant sent to the heat source expansion valve 36 passes the heat source expansion valve 36 controlled in opening degree, and then exchanges heat with the primary refrigerant flowing in the primary flow path 35*b* in the secondary flow path 35*a* of the cascade heat exchanger 35. The refrigerant flowing in the secondary flow path 35*a* of the cascade heat exchanger 35 is evaporated into a low-pressure gas refrigerant and is sent to the secondary switching mechanism 22. The low-pressure gas refrigerant sent to the secondary switching mechanism 22 joins the low-pressure gas refrigerant evaporated in the utilization heat exchanger 52*c* on the suction flow path 23. The refrigerant thus joined is returned to the suction side of the secondary compressor 21 via the secondary accumulator 30.

Behavior during mainly heating operation is executed in this manner.

(10) Structures of Primary Unit and Heat Source Unit

FIG. 7 is a schematic outer appearance view depicting connection between the primary unit 5 and the heat source unit 2.

The primary unit 5 includes the primary casing 5*x* having a plurality of surfaces and a substantially rectangular parallelepiped shape. The primary casing 5*x* accommodates, as part of the primary refrigerant circuit 5*a*, the primary compressor 71, the primary switching mechanism 72, the primary heat exchanger 74, the primary first expansion valve 76, the primary subcooling heat exchanger 103, the primary subcooling circuit 104, the primary subcooling expansion valve 104*a*, the first liquid shutoff valve 108, the first gas shutoff valve 109, and the primary accumulator 105. Extend from the primary casing 5*x* are the primary first connection pipe 111 and the primary second connection pipe 112 as part of the primary refrigerant circuit 5*a*.

The heat source unit 2 includes the heat source casing 2*x* having a substantially rectangular parallelepiped shape. The heat source casing 2*x* accommodates part of the secondary refrigerant circuit 10 and part of the primary refrigerant circuit 5*a*. The heat source casing 2*x* accommodates, as the part of the secondary refrigerant circuit 10, the heat source circuit 12 principally including the secondary compressor 21, the secondary switching mechanism 22, the first heat source pipe 28, the second heat source pipe 29, the suction flow path 23, a discharge flow path 24, the third heat source pipe 25, the fourth heat source pipe 26, the fifth heat source pipe 27, the cascade heat exchanger 35, the heat source expansion valve 36, the third shutoff valve 31, the first shutoff valve 32, the second shutoff valve 33, the secondary accumulator 30, the oil separator 34, the oil return circuit 40, the secondary receiver 45, the bypass circuit 46, the bypass expansion valve 46*a*, the secondary subcooling heat exchanger 47, the secondary subcooling circuit 48, and the secondary subcooling expansion valve 48*a*. The heat source casing 2*x* accommodates the part of the primary refrigerant circuit 5*a*, namely, the second liquid shutoff valve 106, the first connecting pipe 115, the primary receiver 101, the third connecting pipe 114, the primary second expansion valve 102, the cascade heat exchanger 35, the second connecting pipe 113, and the second gas shutoff valve 107. Extend from the heat source casing 2*x* are the secondary third connection pipe 7, the secondary first connection pipe 8, and the secondary second connection pipe 9 as part of the secondary refrigerant circuit 10. Also extend from the heat source casing 2*x* are the primary first connection pipe 111 and the primary second connection pipe 112 as part of the primary refrigerant circuit 5*a*.

The heat source casing 2*x* has a plurality of surfaces including a top surface 120*b*, a first side surface 120*a*, a second side surface 120*c*, a bottom surface 120*d*, as well as a third side surface and a fourth side surface (not depicted). Among these surfaces, the first side surface 120*a* is provided with an opening 120*x* (corresponding to an opening allowing the first pipe and the second pipe to pass therethrough). The primary first connection pipe 111 and the primary second connection pipe 112 pass the opening 120*x*. Both the cascade heat exchanger 35 and the primary receiver 101 are mounted on the bottom surface 120*d*.

The second liquid shutoff valve 106 connected with the primary first connection pipe 111 and the second gas shutoff valve 107 connected with the primary second connection pipe 112 are positioned in the opening 120*x* of the heat source casing 2*x*.

(11) Characteristics of Embodiment

In the refrigeration cycle system 1 according to the present embodiment, the primary receiver 101 in the primary refrigerant circuit 5*a* is provided not at the primary unit 5 but at the heat source unit 2. When the refrigeration cycle system 1 includes the primary unit 5 filled with the primary refrigerant having relatively large quantity, the primary refrigerant circuit 5*a* is likely to have an excessive primary refrigerant, which can be reserved in the primary receiver 101. This configuration can inhibit deterioration in performance of the primary refrigerant circuit 5*a* due to refrigerant excess.

Unlike the refrigeration cycle system 1 according to the present embodiment performing the binary refrigeration cycle, there has been conventionally proposed a system that includes a heat source unit having a compressor and a heat source heat exchanger, and a plurality of utilization units each having a utilization heat exchanger, the heat source unit and the utilization units being connected via relatively long connection pipes, and performs a unitary refrigeration cycle. The heat source unit applied to such a unitary refrigeration cycle may be preliminarily filled with a refrigerant having sufficient quantity, to be connected with the connection pipes on a construction site so as to constitute a unitary refrigeration cycle system. In a case where the heat source unit preliminarily filled with the refrigerant for achievement of the unitary refrigeration cycle is applied as the primary unit 5 according to the above embodiment, which includes, as the cascade heat exchanger, a plate heat exchanger having relatively small inner capacity and used to achieve the binary refrigeration cycle, without adjustment in quantity of the already filled refrigerant, the primary refrigerant circuit is likely to have refrigerant excess. Particularly in a case where the heat source unit 2 according to the present embodiment and the primary unit 5 have a smaller distance therebetween than a distance between a heat source unit and a utilization unit in a unitary refrigeration cycle, the primary refrigerant circuit in the binary refrigeration cycle including the heat source unit for the unitary refrigeration cycle is likely to have significant refrigerant excess. Furthermore, if the heat source unit in the unitary refrigeration cycle includes a subcooling heat exchanger configured to subcool a refrigerant that is conveyed to the utilization units, the primary refrigerant circuit in the binary refrigeration cycle including the heat source unit for the unitary refrigeration cycle is more likely to have significant refrigerant excess. If the heat source unit in the unitary refrigeration cycle does not include any receiver, any excessive refrigerant generated in the primary refrigerant circuit in the binary refrigeration cycle including such a heat source unit does not have any secured destination. The excessive refrigerant thus generated may accumulate in the heat exchanger or the like to possibly cause deterioration in operation efficiency.

In contrast, in the refrigeration cycle system 1 according to the present embodiment, the heat source unit 2 to be connected with the primary unit 5 includes the primary receiver 101. Even in a case where the refrigeration cycle system 1 includes, as the primary unit 5 in the binary refrigeration cycle, the heat source unit in the unitary refrigeration cycle without adjustment in quantity of the preliminarily filled refrigerant, the primary receiver 101 can reserve the excessive refrigerant to inhibit deterioration in operation efficiency.

Furthermore, the primary receiver 101 and the cascade heat exchanger 35 are provided in the heat source unit 2 in the refrigeration cycle system 1 according to the present embodiment. This allows compact accommodation of part of the primary refrigerant circuit 5*a* in the heat source unit 2.

The primary first connection pipe 111 and the primary second connection pipe 112 extending from the heat source unit 2 and connected with the primary unit 5 each extend from the first side surface 120*a* of the heat source casing 2*x*. The second gas shutoff valve 107 and the second liquid shutoff valve 106, as connection targets of the primary first connection pipe 111 and the primary second connection pipe 112, respectively, are each positioned adjacent to the opening 120*x* provided in the first side surface 120*a*. This allows connecting work during construction to be conducted from the first side surface 120*a* of the heat source casing 2*x*, for high workability.

The heat source unit 2 includes the primary second expansion valve 102 provided between the primary flow path 35*b* of the cascade heat exchanger 35 and the primary receiver 101. Decrease in opening degree of the primary second expansion valve 102 during cooling operation and mainly cooling operation leads to increase in quantity of the liquid refrigerant reserved in the primary receiver 101.

In the refrigeration cycle system 1 according to the present embodiment, adoption of carbon dioxide as a refrigerant in the secondary refrigerant circuit 10 decreases the global warming potential (GWP). Even if the refrigerant containing no chlorofluorocarbon leaks on the utilization side, there is no outflow of chlorofluorocarbon on the utilization side.

The refrigeration cycle system 1 according to the present embodiment adopts the binary refrigeration cycle, to exhibit sufficient capacity at the secondary refrigerant circuit 10.

(12) Other Embodiments (12-1) Other Embodiment A

The above embodiment exemplifies the case where the primary receiver 101 is provided in the heat source unit 2.

Figure 8:
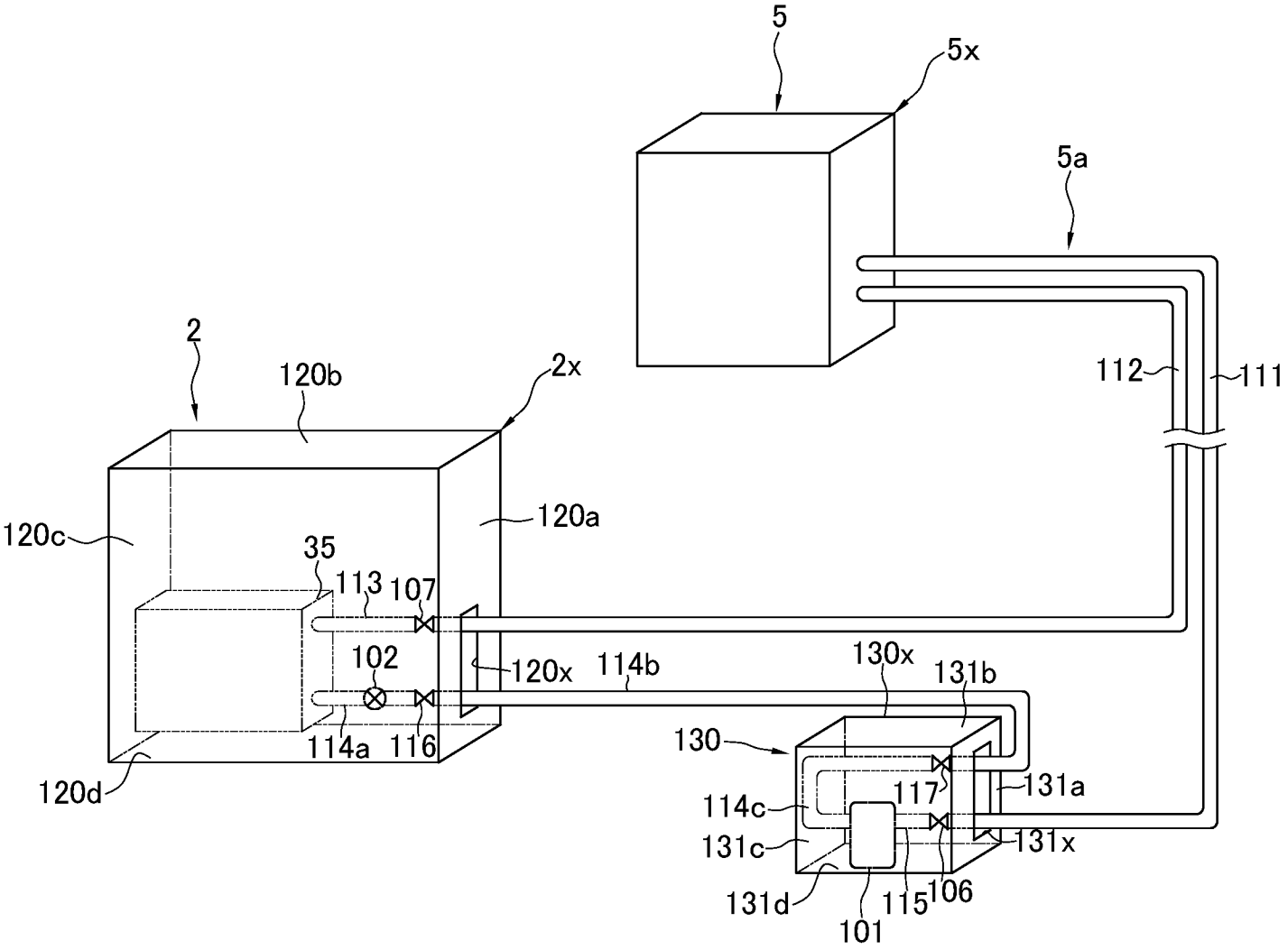
FIG. 8 is a schematic view depicting connection between a primary unit and a heat source unit according to a different embodiment A.

In contrast, as exemplarily depicted in FIG. 8, the refrigeration cycle system may include, separately from the primary unit 5 and the heat source unit 2, a receiver unit 130 including the primary receiver 101 and interposed between the primary unit 5 and the heat source unit 2.

The receiver unit 130 includes a receiver casing 130*x* (corresponding to a third casing) accommodating the primary receiver 101. The receiver casing 130*x* has a top surface 131*b*, a first side surface 131*a*, a second side surface 131*c*, a bottom surface 131*d*, as well as a third side surface and a fourth side surface (not depicted). The first side surface 131*a* is provided with an opening 131*x*. The primary receiver 101 is mounted on the bottom surface 131*d*.

The refrigeration cycle system according to the present embodiment includes, in place of the third connecting pipe 114 according to the above embodiment, a fourth connecting pipe 114*a*, a fourth liquid shutoff valve 116, a fifth connecting pipe 114*b*, a third liquid shutoff valve 117, and a sixth connecting pipe 114*c*. The fourth connecting pipe 114*a* connects the liquid side of the primary flow path 35*b* of the cascade heat exchanger 35 and the fourth liquid shutoff valve 116. The fourth connecting pipe 114*a* is provided with the primary second expansion valve 102. The fourth connecting pipe 114*a*, the primary second expansion valve 102, and the fourth liquid shutoff valve 116 are each provided at the heat source unit 2. The fourth liquid shutoff valve 116 is positioned adjacent to the opening 120*x* provided in the first side surface 120*a* of the heat source casing 2*x*. The fifth connecting pipe 114*b* connects the fourth liquid shutoff valve 116 in the heat source casing 2*x* and the third liquid shutoff valve 117 in the receiver casing 130*x*. The third liquid shutoff valve 117, the sixth connecting pipe 114*c*, the primary receiver 101, the first connecting pipe 115, and the second liquid shutoff valve 106 are provided at the receiver unit 130. The third liquid shutoff valve 117 and the second liquid shutoff valve 106 are positioned adjacent to the opening 131*x* provided in the first side surface 131*a* of the receiver casing 130*x*. The sixth connecting pipe 114*c* connects the third liquid shutoff valve 117 and the primary receiver 101. The first connecting pipe 115 connects the primary receiver 101 and the second liquid shutoff valve 106.

Also in this configuration, a device used as a heat source unit in a unitary refrigeration cycle system can also function as the primary unit 5. Furthermore, the heat source unit 2 not including the primary receiver 101 can be reduced in size. Moreover, connecting work for the receiver unit 130 can be conducted from the same side surface for high workability.

If the receiver unit 130 is provided separately from the heat source unit 2, the heat source casing 2*x* and the receiver casing 130*x* may be integrated with each other.

(12-2) Other Embodiment B

The above embodiment exemplifies the case where the cascade heat exchanger 35 is accommodated in the heat source casing 2*x* of the heat source unit 2.

In contrast, the cascade heat exchanger 35 may be disposed in separate casing provided outside the heat source casing 2*x* of the heat source unit 2. In this case, the casing provided with the cascade heat exchanger 35 and the heat source casing 2*x* of the heat source unit 2 may be integrated with each other.

(12-3) Other Embodiment C

The above embodiment exemplifies the structure in which the primary first connection pipe 111 and the primary second connection pipe 112 pass the single opening 120*x* provided in the first side surface 120*a* of the heat source casing 2*x*.

In contrast, the heat source casing 2*x* may be provided with an opening allowing the primary first connection pipe 111 to pass therethrough and another opening allowing the primary second connection pipe 112 to pass therethrough. Also in this case, connecting work is facilitated if the openings are provided in one of the surfaces of the heat source casing 2*x*.

(12-4) Other Embodiment D

The above embodiment exemplifies R32 as the refrigerant provided in the primary refrigerant circuit 5*a* and carbon dioxide as the refrigerant provided in the secondary refrigerant circuit 10.

However, the refrigerant provided in the primary refrigerant circuit 5*a* should not be limited, and examples thereof include HFC-32, an HFO refrigerant, a refrigerant obtained by mixing HFC-32 and the HFO refrigerant, carbon dioxide, ammonia, and propane.

Furthermore, the refrigerant provided in the secondary refrigerant circuit 10 should not be limited, and examples thereof include HFC-32, an HFO refrigerant, a refrigerant obtained by mixing HFC-32 and the HFO refrigerant, carbon dioxide, ammonia, and propane.

Examples of the HFO refrigerant include HFO-1234yf and HFO-1234ze.

The primary refrigerant circuit 5*a* and the secondary refrigerant circuit 10 may adopt a same refrigerant or different refrigerants.

(12-5) Other Embodiment E

The above embodiment exemplifies, as the secondary refrigerant circuit 10, a refrigerant circuit having three pipes of the secondary first connection pipe 8, the secondary second connection pipe 9, and the secondary third connection pipe 7, and configured to simultaneously execute cooling operation and heating operation.

However, the secondary refrigerant circuit 10 should not be limited to such a refrigerant circuit configured to simultaneously execute cooling operation and heating operation, and may be a circuit including the heat source unit 2 and the utilization units 3*a*, 3*b*, and 3*c* connected via two connection pipes.

(12-6) Others

The cascade heat exchanger may be configured to cause heat exchange between the first refrigerant and the second refrigerant.

In this case, the cascade heat exchanger may be accommodated in the second casing. Alternatively, the cascade heat exchanger may be accommodated in a casing provided separately from the second casing, and the separate casing and the second casing may be unitized.

In this case, the receiver may be accommodated in the second casing. Alternatively, the receiver may be accommodated in a casing provided separately from the second casing, and the separate casing and the second casing may be unitized.

The second casing may be substantially a hexahedron.

APPENDIX

The embodiments of the present disclosure have been described above. Various modifications to modes and details should be available without departing from the object and the scope of the present disclosure recited in the patent claims.

REFERENCE SIGNS LIST

1: refrigeration cycle system
2: heat source unit
2*x*: heat source casing (second casing)
3*a*: first utilization unit
3*b*: second utilization unit
3*c*: third utilization unit
5: primary unit
5*a*: primary refrigerant circuit (first circuit)
5*x*: primary casing (first casing)
7: secondary third connection pipe (connection pipe)
8: secondary first connection pipe (connection pipe)
9: secondary second connection pipe (connection pipe)
10: secondary refrigerant circuit (second circuit)
12: heat source circuit
13*a-c*: utilization circuit
20: heat source control unit
21: secondary compressor (second compressor)
21*a*: compressor motor
22: secondary switching mechanism
23: suction flow path
24: discharge flow path
25: third heat source pipe
26: fourth heat source pipe
27: fifth heat source pipe
28: first heat source pipe
29: second heat source pipe
30: secondary accumulator
34: oil separator
35: cascade heat exchanger
35*a*: secondary flow path
35*b*: primary flow path
36: heat source expansion valve
37: secondary suction pressure sensor
38: secondary discharge pressure sensor
39: secondary discharge temperature sensor
40: oil return circuit
41: oil return flow path
42: oil return capillary tube
44: oil return on-off valve
45: secondary receiver
46: bypass circuit
46*a*: bypass expansion valve
47: secondary subcooling heat exchanger
48: secondary subcooling circuit
48*a*: secondary subcooling expansion valve
50*a-c*: utilization control unit
51*a-c*: utilization expansion valve
52*a-c*: utilization heat exchanger (second heat exchanger)
53*a-c*: indoor fan
56*a*, 56*b*, 56*c*: second utilization pipe
57*a*, 57*b*, 57*c*: first utilization pipe
58*a*, 58*b*, 58*c*: liquid-side temperature sensor
60*a*, 60*b*, 60*c*: branching unit control unit
61*a*, 61*b*, 61*c*: third branching pipe
62*a*, 62*b*, 62*c*: junction pipe
63*a*, 63*b*, 63*c*: first branching pipe
64*a*, 64*b*, 64*c*: second branching pipe
66*a*, 66*b*, 66*c*: first control valve
67*a*, 67*b*, 67*c*: second control valve
70: primary control unit
71: primary compressor (first compressor)

72: primary switching mechanism
74: primary heat exchanger (first heat exchanger)
76: primary first expansion valve
77: outdoor air temperature sensor
78: primary discharge pressure sensor
79: primary suction pressure sensor
81: primary suction temperature sensor
82: primary heat-exchange temperature sensor
83: secondary cascade temperature sensor
84: receiver outlet temperature sensor
85: bypass circuit temperature sensor
86: subcooling outlet temperature sensor
87: subcooling circuit temperature sensor
88: secondary suction temperature sensor
80: control unit
101: primary receiver (receiver)
102: primary second expansion valve (expansion valve)
103: primary subcooling heat exchanger
104: primary subcooling circuit
104*a*: primary subcooling expansion valve
105: primary accumulator
111: primary first connection pipe (first pipe)
112: primary second connection pipe (second pipe)
113: second connecting pipe
114: third connecting pipe
115: first connecting pipe
120*a*: first side surface (surface)
120*b*: top surface (surface)
120*c*: second side surface (surface)
120*d*: bottom surface (surface)
120*x*: opening (opening allowing first pipe and second pipe to pass therethrough)
130: receiver unit
130*x*: receiver casing (third casing)
131*a*: connecting surface
131*x*: opening

CITATION LIST

Patent Literature

Patent Literature 1: WO 2018/235832 A

The invention claimed is:

1. A refrigeration cycle system comprising:

a first circuit allowing circulation of a first refrigerant, the first circuit including a first compressor, a cascade heat exchanger, a receiver, and a first heat exchanger;

a second circuit allowing circulation of a second refrigerant, the second circuit including a second compressor, the cascade heat exchanger, and a second heat exchanger;

a first casing accommodating the first compressor; and a second casing accommodating the second compressor; wherein the receiver is provided outside the first casing, the cascade heat exchanger is provided at the second casing, and the receiver is provided at the second casing.

2. The refrigeration cycle system according to claim 1, wherein the first circuit includes a first pipe extending from the cascade heat exchanger to outside the second casing, and a second pipe extending from the receiver to outside the second casing, the second casing has a plurality of surfaces, and the first pipe and the second pipe pass an opening, or the first pipe passes an opening and the second pipe passes another opening, and each of the openings is provided in one of the surfaces.

3. The refrigeration cycle system according to claim 1, wherein the first circuit includes an expansion valve provided between the cascade heat exchanger and the receiver.

4. The refrigeration cycle system according to claim 2, wherein the first circuit includes an expansion valve provided between the cascade heat exchanger and the receiver.

* * * * *